US008752823B2

(12) United States Patent
Hayashi et al.

(10) Patent No.: US 8,752,823 B2
(45) Date of Patent: Jun. 17, 2014

(54) SHEET FEEDING APPARATUS AND IMAGE FORMING APPARATUS

(75) Inventors: Naoki Hayashi, Kawasaki (JP); Masatoshi Takiguchi, Yokohama (JP); Seietsu Miura, Numazu (JP); Ryukichi Inoue, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 88 days.

(21) Appl. No.: 13/409,577

(22) Filed: Mar. 1, 2012

(65) Prior Publication Data

US 2012/0242033 A1 Sep. 27, 2012

(30) Foreign Application Priority Data

Mar. 24, 2011 (JP) ..... 2011-065999

(51) Int. Cl.
*B65H 3/06* (2006.01)

(52) U.S. Cl.
USPC ..... 271/160; 271/119; 271/147; 271/126; 271/114

(58) Field of Classification Search
USPC ..... 271/114, 119, 126, 127, 147, 160
See application file for complete search history.

(56) References Cited

U.S. PATENT DOCUMENTS

| | | | | |
|---|---|---|---|---|
| 4,717,139 | A * | 1/1988 | Sootome et al. | 271/116 |
| 5,253,854 | A | 10/1993 | Tanoue et al. | |
| 5,292,116 | A | 3/1994 | Inoue et al. | |
| 5,358,230 | A | 10/1994 | Ikemori et al. | |
| 5,651,540 | A | 7/1997 | Watanabe et al. | |
| 5,907,745 | A | 5/1999 | Azuma et al. | |
| 6,055,407 | A | 4/2000 | Inoue et al. | |
| 6,305,682 | B1 * | 10/2001 | Saito et al. | 271/10.11 |
| 6,308,947 | B1 | 10/2001 | Kojima et al. | |
| 6,357,740 | B1 | 3/2002 | Inoue et al. | |
| 6,375,183 | B1 | 4/2002 | Inoue et al. | |
| 6,382,621 | B1 | 5/2002 | Inoue et al. | |
| 6,485,015 | B2 * | 11/2002 | Yen et al. | 271/121 |
| 6,502,816 | B2 | 1/2003 | Inoue et al. | |
| 6,769,680 | B2 | 8/2004 | Kojima et al. | |
| 6,896,253 | B2 * | 5/2005 | Hanabusa | 271/117 |
| 7,111,934 | B2 * | 9/2006 | Okuda et al. | 347/104 |
| 7,364,152 | B2 * | 4/2008 | Suwa | 271/118 |
| 7,614,622 | B2 * | 11/2009 | Muramatsu | 271/119 |
| 7,980,551 | B2 * | 7/2011 | Kobayashi | 271/121 |
| 2011/0156336 | A1 | 6/2011 | Agata et al. | |
| 2011/0316222 | A1 | 12/2011 | Takiguchi et al. | |
| 2011/0316223 | A1 | 12/2011 | Takiguchi et al. | |

FOREIGN PATENT DOCUMENTS

| | | |
|---|---|---|
| JP | H07-257765 | 10/1995 |

* cited by examiner

*Primary Examiner* — Ernesto Suarez
(74) *Attorney, Agent, or Firm* — Fitzpatrick, Cella, Harper & Scinto

(57) ABSTRACT

The sheet feeding apparatus includes a feeding roller that includes an arc-shaped friction portion and a notch portion, and causes the friction portion to feed the sheet; a feeding motor rotationally driving the feeding roller; a separation pad that presses the sheet fed by the friction portion on a surface other than a surface at the friction portion, and separates a double-fed sheet; and a feeding spring that causes the sheet supporting portion to wait below the feeding roller such that the sheet supported on the sheet supporting portion is not in contact with the friction portion until the friction portion reaches the separation pad, and, when the friction portion reaches the separation pad, moves up the sheet supporting portion to an abutting position at which the sheet supported on the sheet supporting portion is pressed against the friction portion and the friction portion feeds the sheet.

10 Claims, 16 Drawing Sheets

| FIG. 8A |
| --- |
| FIG. 8B |

SHEET FEEDING APPARATUS AND IMAGE FORMING APPARATUS

BACKGROUND OF THE INVENTION

1. Field of the Invention

The present invention relates to a sheet feeding apparatus and an image forming apparatus including the same, and more specifically, to a sheet feeding apparatus that separates sheets one by one and feeds the sheets and an image forming apparatus including the same.

2. Description of the Related Art

Conventionally, an image forming apparatus includes a sheet feeding apparatus that separates sheets stacked on a sheet stacking plate one by one from the top of the stack and feeds the sheets to the image forming apparatus. The sheet feeding apparatus urges the sheet stacking plate, which is provided to be movable up and down, against a feeding roller by a coil spring to thereby contact the top surface of the stacked sheet with a feeding follower roller rotatably supported about the same axis as the feeding roller. Subsequently, the feeding roller rotates, thereby contacting the friction portion provided on the feeding roller with the sheet, which is fed while being separated one by one by a separation pad provided in a manner pressed against the friction portion. This technique is disclosed in Japanese Patent Application Laid-Open No. H07-257765.

In recent years, demands for a thin sheet of paper (hereinafter referred to as a "thin sheet") containing small amount of pulp (low basic weight) has increased because of increase in awareness of the environment. However, the thin sheet has a low rigidity. Accordingly, there is a problem of easily causing a jam because of difficulty in feeding in a case of using the sheet in a conventional, compact, low-cost image forming apparatus.

Here, a jam of a thin sheet is described with reference to FIGS. 16A to 16C. As illustrated in FIG. 16A, in a conventional image forming apparatus, even if the sheet is subjected to double feeding according to a dragging phenomenon due to a frictional force between sheets in an immediately previous feeding step, the sheet is separated at a separation pad 19. Accordingly, a sheet S1 sometimes remains between the separation pad 19 and the feeding follower roller 18.

In this state, when a feeding roller 15 rotates in the direction of an arrow R1 and a sheet supporting portion 3 rotates in the direction of an arrow R2 by an urging force of a feeding spring 5 according to a feeding signal from a control part, the sheet S1 is sandwiched between a sheet stack T and the feeding follower roller 18 as illustrated in FIG. 16B. When the feeding roller 15 rotates from the state illustrated in FIG. 16B in the direction of arrow R1, the tip of a friction portion 15*a* of the feeding roller 15 abuts against the sheet S1 as illustrated in FIG. 16C.

At this time, as illustrated in FIG. 16D, the sheet S1 is subjected to a frictional force in the direction of an arrow F1 at an abutting position P1 where the sheet abuts on the tip of the friction portion 15*a* of the feeding roller 15, and the tip is subjected to a frictional force in the direction of an arrow F2 from the separation pad 19. Accordingly, if the rigidity of the sheet S1 is low, the frictional forces cause buckling of the sheet S1. With buckling of the sheet S1, the image forming apparatus easily causes a jam.

In particular, a compact and low-cost image forming apparatus (sheet feeding apparatus) easily causes the dragging phenomenon. Accordingly, with a thin sheet for which the demand is assumed to increase, there is a possibility that a jam due to buckling causes a problem more than the present state.

On the other hand, it can be considered that the problem of a jam due to buckling is solved by providing a sheet separation device for preventing the dragging phenomenon of a sheet. However, the device requires a complicated mechanism. Accordingly, it is difficult to realize the device with an inexpensive configuration, and it is difficult to mounting the device on a compact and low-cost image forming apparatus.

SUMMARY OF THE INVENTION

Thus, an object of the present invention is to provide a sheet feeding apparatus and an image forming apparatus that is capable of suppressing occurrence of buckling of a sheet due to a dragging phenomenon of the sheet and realize stable feeding using a simple configuration even with a sheet having a low basic weight.

A purpose of the present invention is to provide a sheet feeding apparatus, including a sheet supporting portion that supports a sheet and is movable up or down, a feeding roller that includes an arc-shaped friction portion and a notch portion at which a part in a circumferential direction is cut out, and allows the friction portion to feed the sheet supported by the sheet supporting portion, a rotation driving unit for rotationally driving the feeding roller, a friction separation member that presses the sheet fed by the friction portion on a surface other than a surface at the friction portion, and separates a double-fed sheet, and an elevating unit that causes the sheet supporting portion to wait below the feeding roller such that the sheet supported on the sheet supporting portion is not in contact with the friction portion until the friction portion reaches the friction separation member, and, when the friction portion reaches the friction separation member, moves up the sheet supporting portion to a push position at which the sheet supported on the sheet supporting portion is pressed against the friction portion and the friction portion feeds the sheet.

A further purpose of the present invention is to provide an image forming apparatus, including a sheet supporting portion that supports a sheet and is provided so as to be movable up or down, a feeding roller that includes an arc-shaped friction portion and a notch portion at which a part in a circumferential direction is cut out, and causes the friction portion to feed the sheet supported by the sheet supporting portion, a rotation driving unit for rotationally driving the feeding roller, friction separation member that presses the sheet fed by the friction portion on a surface other than a surface at the friction portion, and separates a double-fed sheet, n elevating unit that causes the sheet supporting portion to wait below the feeding roller such that the sheet supported on the sheet supporting portion is not in contact with the friction portion until the friction portion reaches the friction separation member, and, when the friction portion reaches the friction separation member, moves up the sheet supporting portion to a push position at which the sheet supported on the sheet supporting portion is pressed against the friction portion and the friction portion feeds the sheet, and an image forming portion that forms an image on the sheet fed by the feeding roller.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An image forming apparatus including a sheet-feeding portion is hereinafter described with reference to diagrams. The image forming apparatus according to an embodiment of the present invention is an image forming apparatus, such as a copier, a printer, a facsimile and a multifunction machine, including a sheet feeding apparatus that separates a sheet one by one and feeds the sheet.

<First Embodiment>

Figure 1:
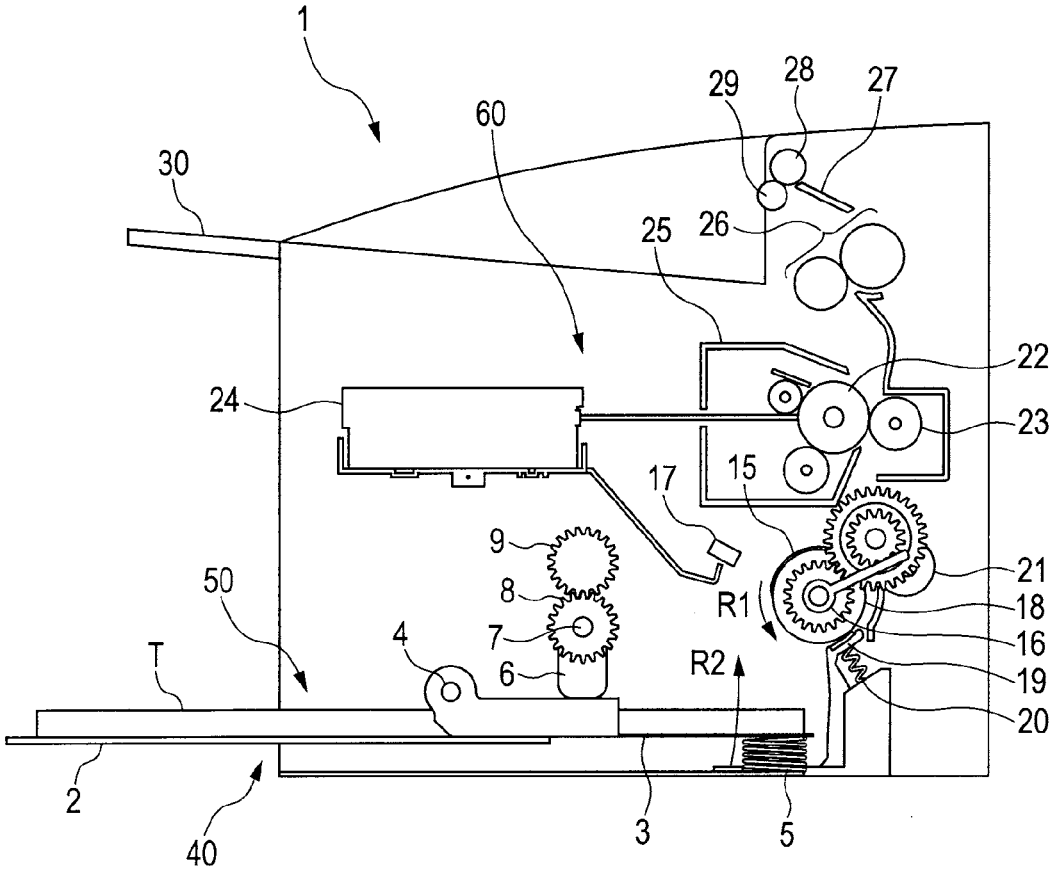
FIG. 1 is a sectional view schematically illustrating an image forming apparatus according to a first embodiment of the present invention.

An image forming apparatus 1 according to a first embodiment of the present invention is described with reference to FIGS. 1 to 9D. First, a schematic configuration of the image forming apparatus 1 according to the first embodiment is described according to the movement of a sheet S with reference to FIG. 1. FIG. 1 is a sectional view schematically illustrating the image forming apparatus 1 according to the first embodiment of the present invention.

As illustrated in FIG. 1, the image forming apparatus 1 includes a sheet storage 40 storing the sheet S, a sheet-feeding portion 50 as a sheet feeding apparatus, and an image forming portion 60 forming an image on the sheet S fed by the sheet-feeding portion 50. The sheet-feeding portion 50 is disposed at the bottom of the image forming apparatus 1, and feeds the sheet S stored in the sheet storage 40 to the image forming portion 60. The sheet-feeding portion 50 will be described later in detail.

The sheets S are set in a state of being stacked on a feeding tray 2 of the sheet storage 40 and a sheet supporting portion 3 (hereinafter, the sheets S in the state of being stacked on the feeding tray 2 and the sheet supporting portion 3 are referred to as a "sheet stack T"). A feeding operation for the sheet stack T set on the feeding tray 2 and the sheet supporting portion 3 is started by activation of a drive motor, not illustrated. For instance, by activation of the drive motor, not illustrated, a solenoid (not illustrated) for the feeding portion is operated, thereby starting the feeding operation. On starting of the feeding operation, by an urging force in an R2 direction of a feeding spring 5 included in an elevating unit, the sheet supporting portion 3 that supports the sheet and is movable up or down rises toward the feeding roller 15 about a shaft 4 included in the elevating unit. That is, the sheet supporting portion 3 stands by at the bottom position moves up from the bottom position toward the feeding roller 15. Accordingly, the sheet S of the top surface of the sheet stack T supported on the sheet supporting portion 3 is pushed onto the feeding roller 15. The sheet S pushed onto the feeding roller 15 is fed by rotation of the feeding roller 15. Subsequently, the sheet S passes through a pair of conveying rollers 21 and is conveyed to the image forming portion 60. At this time, if the sheet S is subjected to double feeding, the sheet is separated one by one by a separation pad 19 as a friction separation member.

The image forming portion 60 is disposed above the sheet-feeding portion 50, and includes a photosensitive member 22 disposed in the process cartridge 25, a transfer roller 23 and a laser scanner 24. The sheet S fed to the image forming portion 60 is conveyed to a transfer nip including the photosensitive member 22 and the transfer roller 23. The laser scanner 24 forms an electrostatic latent image on the photosensitive member 22. The electrostatic latent image thus formed on the photosensitive member 22 by the laser scanner 24 becomes a toner image by adhesion of the toner in the process cartridge 25. The toner image is transferred into an unfixed image on the sheet S in the transfer nip including the photosensitive member 22 and the transfer roller 23. The sheet S on which the unfixed image is transferred is conveyed to the fixation device 26 for heat fixation. The unfixed image is fixed by heating.

The image-fixed sheet S is conveyed to an ejection roller 28 along a conveyance guide 27. The ejection roller 28 forms a nip with an ejection follower roller 29 urged thereagainst by an elastic force, and ejects the sheet S to a sheet discharge tray 30.

Figure 2A:
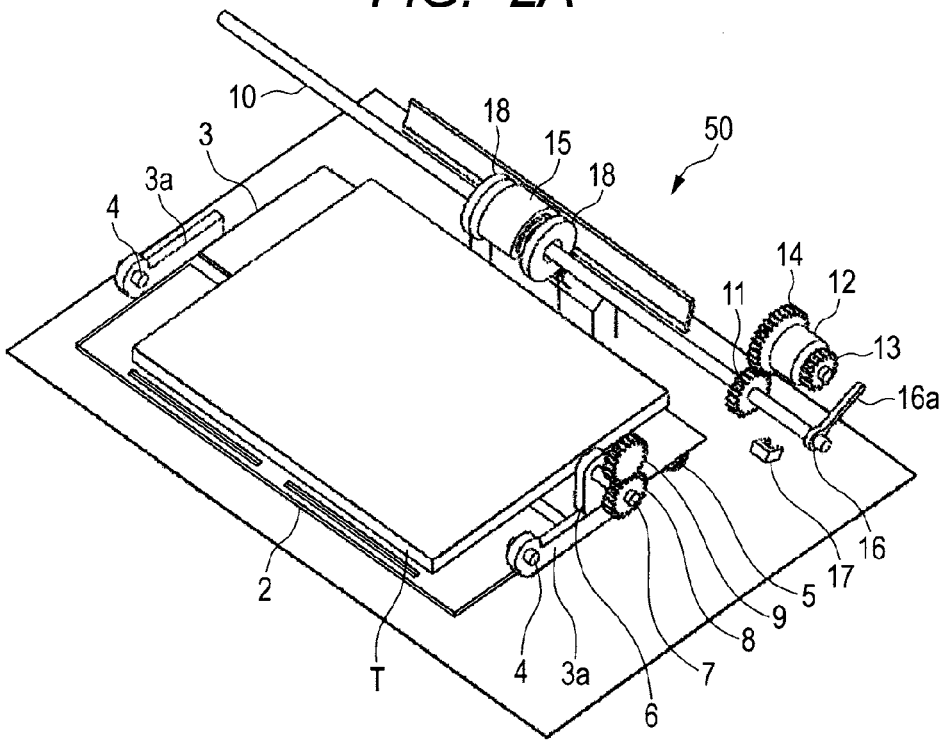
FIG. 2A is a perspective view illustrating a main part of a sheet-feeding portion according to the first embodiment.
Figure 2B:
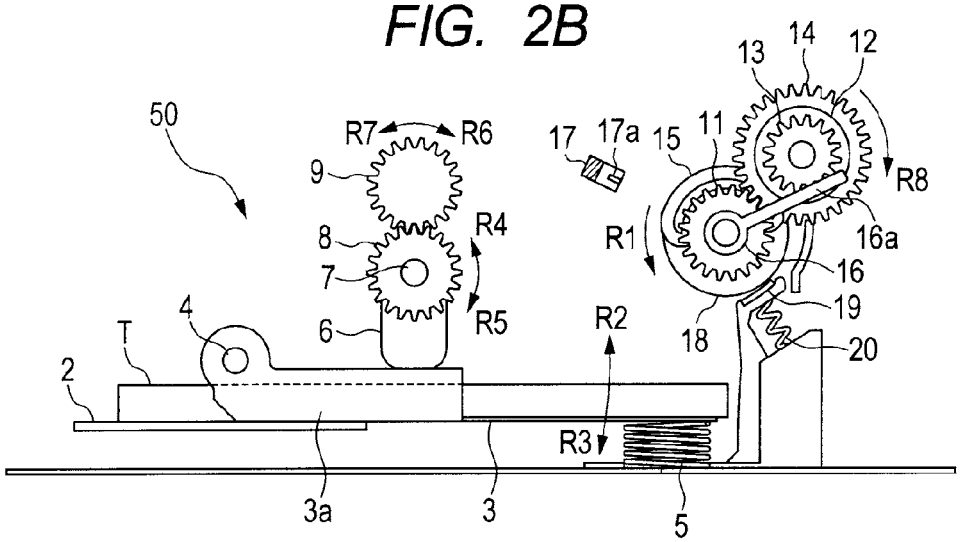
FIG. 2B is a side view of the sheet-feeding portion illustrated in FIG. 2A.

Next, the sheet-feeding portion 50 of the first embodiment is specifically described with reference to FIGS. 2A to 9D in addition to FIG. 1. First, the overall configuration of the sheet-feeding portion 50 is described with reference to FIGS. 2A and 2B. FIG. 2A is a perspective view illustrating a main part of the sheet-feeding portion 50 of the first embodiment. FIG. 2B is a side view of the sheet-feeding portion 50 illustrated in FIG. 2A.

As illustrated in FIGS. 2A and 2B, the sheet stack T is stacked on the feeding tray 2 and the sheet supporting portion 3 on which the sheet S can be stacked. The feeding tray 2 and the sheet supporting portion 3 are disposed in parallel. The feeding tray 2 is disposed upstream in a sheet feeding direction. The sheet supporting portion 3 is disposed downstream of the sheet feeding direction.

The sheet supporting portion 3 is supported by the shaft 4 supported by a frame, not illustrated, about this shaft 4 so as to be rotatable in directions of arrow R2 and R3 illustrated in FIG. 2B. The sheet supporting portion 3 is supported upstream in the sheet feeding direction by the shaft 4, thereby allowing a downstream part in the sheet feeding direction to move up and down. The feeding spring 5 is disposed downstream in the sheet feeding direction below the sheet supporting portion 3, and urges the sheet supporting portion 3 in the direction of arrow R2.

The proximal end of the sheet supporting portion cam 6 as a cam member configuring the elevating unit is fixedly supported by a sheet supporting portion cam shaft 7 configuring the elevating unit. On the other hand, the tip of the sheet supporting portion cam 6 is rotatable in directions of arrows R4 and R5 in synchronization with the rotation of the sheet supporting portion gear 8 configuring the elevating unit fixedly supported by the sheet supporting portion cam shaft 7. The tip of the sheet supporting portion cam 6 is engaged with a cam follower 3*a* configuring the elevating unit connected to opposite sides of the sheet supporting portion 3 (orthogonal to the sheet feeding direction), and has a function of controlling the sheet supporting portion 3 to move up and down against the urging force of the feeding spring 5. A cam surface formed at the tip of the sheet supporting portion cam 6 is formed such that, after the friction portion 15*a* of the feeding roller 15 stops at the separation pad 19, the sheet supporting portion 3 moves to the push position. The gear configuring the elevating unit transmits the rotation driving force from a sheet supporting portion drive motor, not illustrated, configuring the elevating unit to the sheet supporting portion gear 8.

A feeding shaft 10 configuring the rotation driving unit is rotatably supported by a frame, not illustrated. A feeding gear 11 configuring the rotation driving unit is fixed to the feeding shaft 10, and transmits a driving force transmitted from a feeding motor (not illustrated) configuring the rotation driving unit to the feeding shaft 10. An electromagnetic clutch 12 configuring the rotation driving unit does or does not transmit a rotation driving force between a gear 13 configuring the rotation driving unit connected to a feeding motor, not illustrated, and a gear 14 configuring the rotation driving unit meshed with the feeding gear 11, according to an instruction from the after-mentioned control part 70. That is, this clutch connects the gears 13 and 14 to each other.

The feeding roller 15 is fixed to the feeding shaft 10, and includes the friction portion 15*a* that is made of rubber and has the shape of an arc, and a notch portion 15*b* at which a part in the circumferential direction is cut out. The friction portion 15*a* is pressed against the sheet S disposed at the top surface of the sheet stack T and feeds the sheet S. A flag 16 configuring a detection unit is fixed at the end of the feeding shaft 10 and rotates about the feeding shaft 10 in the same phase as the feeding roller 15. The flag 16 includes a photo sensor blockage portion 16*a*. A photo sensor 17 as the detection unit is disposed in the rotational operation range of the flag 16. When the flag 16 rotates, the photo sensor blockage portion 16*a* blocks an infrared light passage 17*a* of the photo sensor 17. The feeding follower rollers 18 are rotatably supported by the feeding shaft 10 at both sides of the feeding roller 15.

The separation pad 19 is made of a frictional material, and disposed at a position that is downstream of the sheet storage 40 in the sheet feeding direction and opposite to the feeding roller 15. The separation pad 19 is urged to be in pressure-contact with the friction portion 15*a* of the feeding roller 15 and the feeding follower rollers 18 by a separation pad spring 20 provided at the back of the separation pad 19. For instance, when a plurality of sheets are fed from the sheet stack T during feeding of the sheet S (also referred to as "double feeding"), the separation pad 19 the separation pad 19 separates only one sheet at the top by being in pressure-contact with the sheet S on the surface other than the surface at the friction portion 15*a*.

Figure 3:
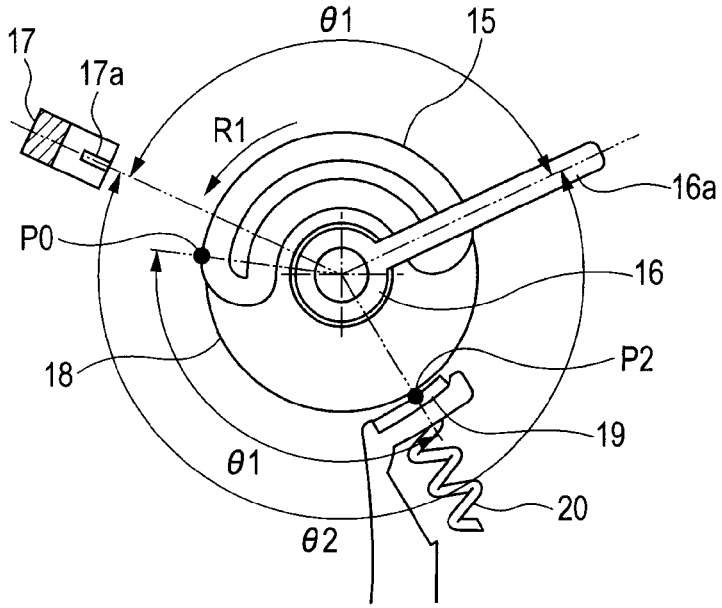
FIG. 3 is a diagram illustrating a rotational position of a feeding roller of the sheet-feeding portion according to the first embodiment.

Next, the friction portion 15*a* of the feeding roller 15 and the photo sensor blockage portion 16*a* of the flag 16 rotational position is described with reference to FIG. 3. FIG. 3 is a diagram for illustrating the rotational position of the sheet-feeding roller 15 of the sheet-feeding portion 50 according to the first embodiment. The position illustrated in FIG. 3 indicates the initial positions of the friction portion 15*a* of the feeding roller 15 and the photo sensor blockage portion 16*a* provided at the flag 16. Here, the position of the tip of the friction portion 15*a* at its initial position is represented as a position P0. When the feeding roller 15 rotates in the direction of the arrow R1 illustrated in FIG. 3, the position where the tip of the friction portion 15*a* abuts on the separation pad 19 or mutually abuts on a prescribed amount is represented as the contact position P2. The angle from the position P0 to the contact position P2 is represented as an angle θ1. As illustrated in FIG. 3, the angle in which the photo sensor blockage portion 16*a* rotates from the initial position in the direction of arrow R1 and blocks the infrared light passage 17*a* is identical to the angle θ1 from the position P0 to the contact position P2. The angle θ2 in which the photo sensor blockage portion 16*a* blocks the infrared light passage 17*a* and further rotates in the direction of arrow R1 to return to the initial position is angle θ2=360°−θ1.

Next, sheet feeding control for the sheet-feeding portion 50 according to the first embodiment is described with reference to FIGS. 4 to 8.

Figure 4:
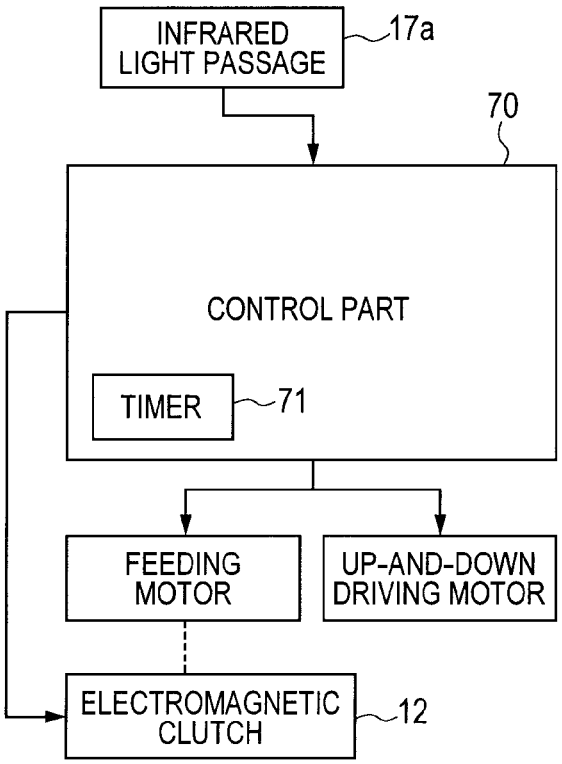
FIG. 4 is a block diagram for illustrating feeding of a sheet concerning a control part according to the first embodiment.

First, referring to FIG. 4, the control part 70 controlling feeding of the sheet-feeding portion 50 is described. FIG. 4 is a block diagram of the control part 70 for feeding the sheet according to the first embodiment. As illustrated in FIG. 4, the control part 70 is electrically connected to the infrared light passage 17*a*. When the infrared light passage 17*a* is blocked by the photo sensor blockage portion 16*a*, a prescribed signal is input from the infrared light passage 17*a* into this control part. The control part 70 includes a timer 71. The timer 71 measures a drive time of the feeding motor and the sheet supporting portion drive motor that are electrically connected to the control part 70. The control part 70 is electrically connected to the electromagnetic clutch 12, and controls connection between the gears 13 and 14.

Figure 5A:
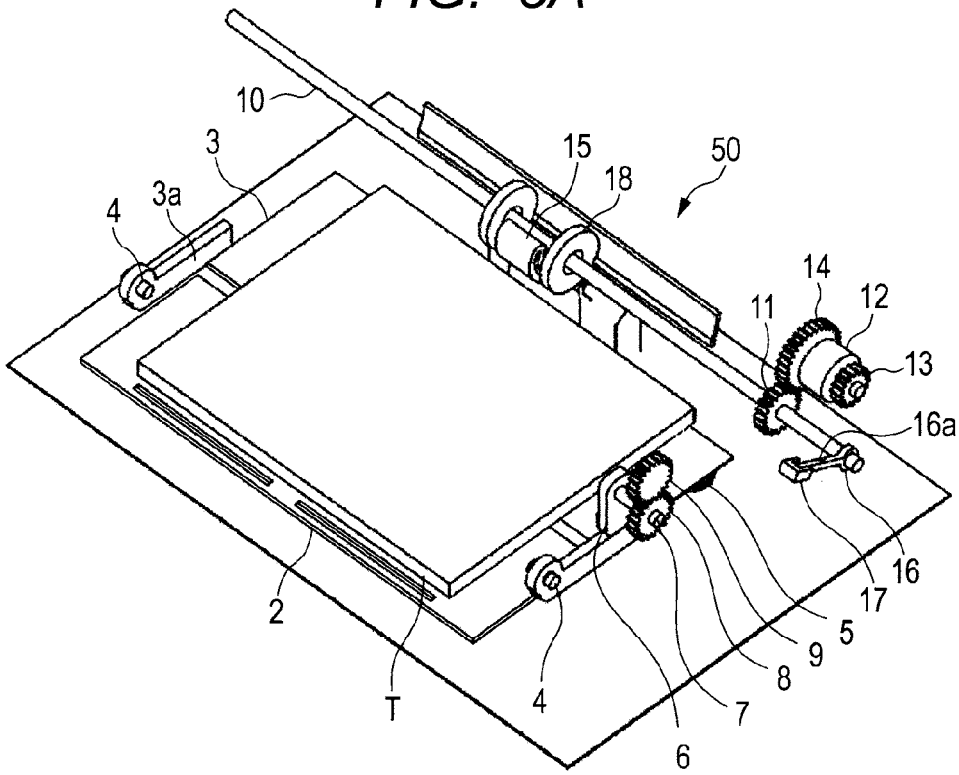
FIG. 5A is a perspective view illustrating a state where a tip of a friction portion of the sheet-feeding portion according to the first embodiment rotates to a contact position.
Figure 5B:
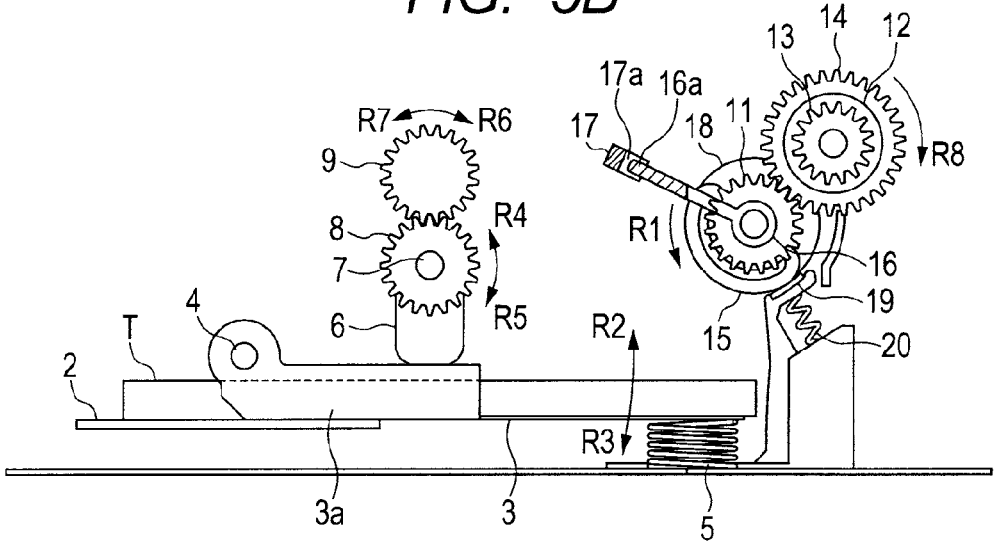
FIG. 5B is a side view of the sheet-feeding portion illustrated in FIG. 5A.
Figure 6A:
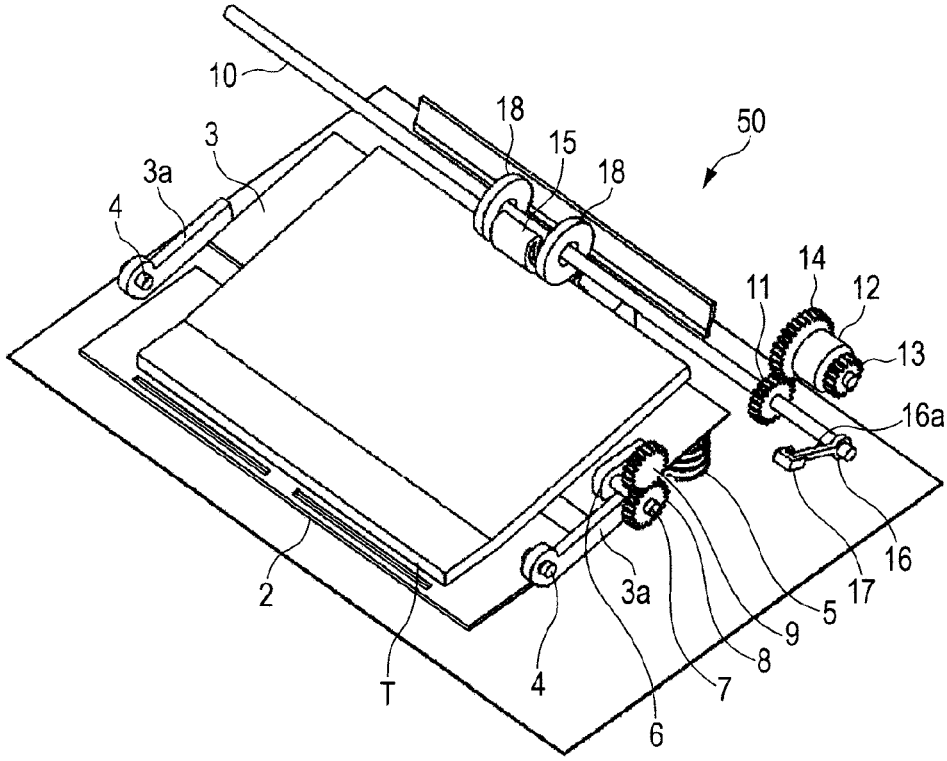
FIG. 6A is a perspective view illustrating a state where a sheet supporting portion of the sheet-feeding portion of the first embodiment moves up to contact the sheet with the friction portion.
Figure 6B:
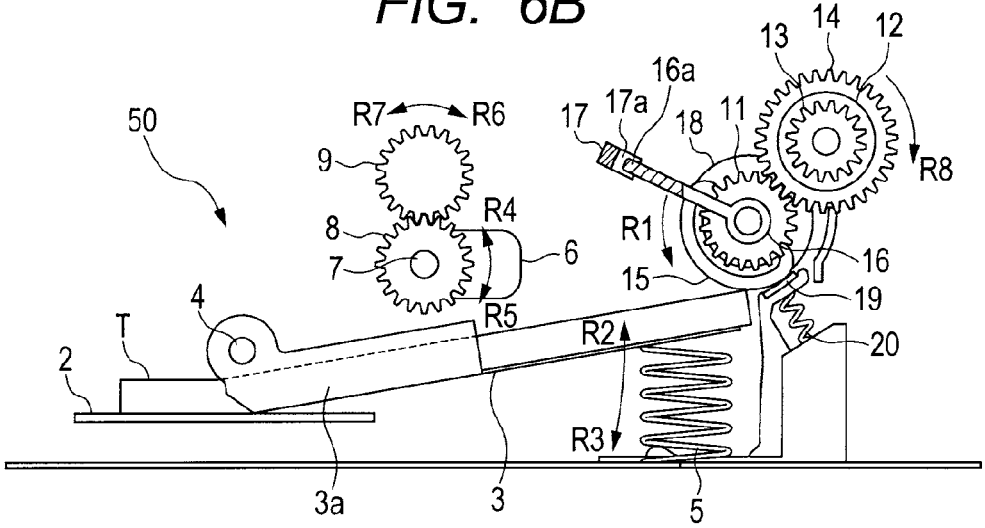
FIG. 6B is a side view of the sheet-feeding portion illustrated in FIG. 6A.
Figure 7A:
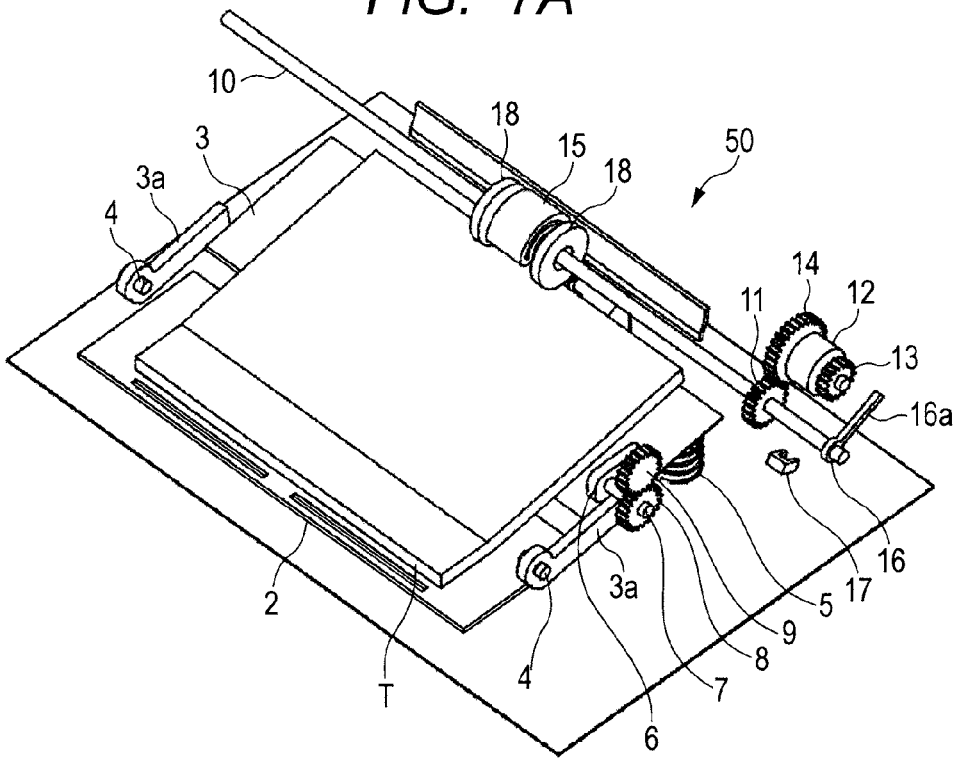
FIG. 7A is a perspective view of the friction portion of the sheet-feeding portion of the first embodiment feeds the sheet.
Figure 7B:
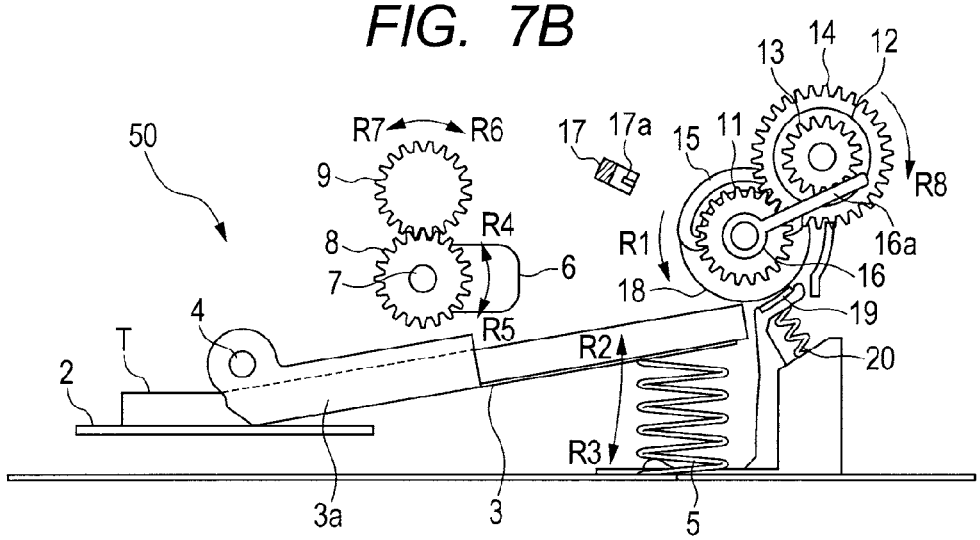
FIG. 7B is a side view of the sheet-feeding portion illustrated in FIG. 7A.
Figures 8, 8A:
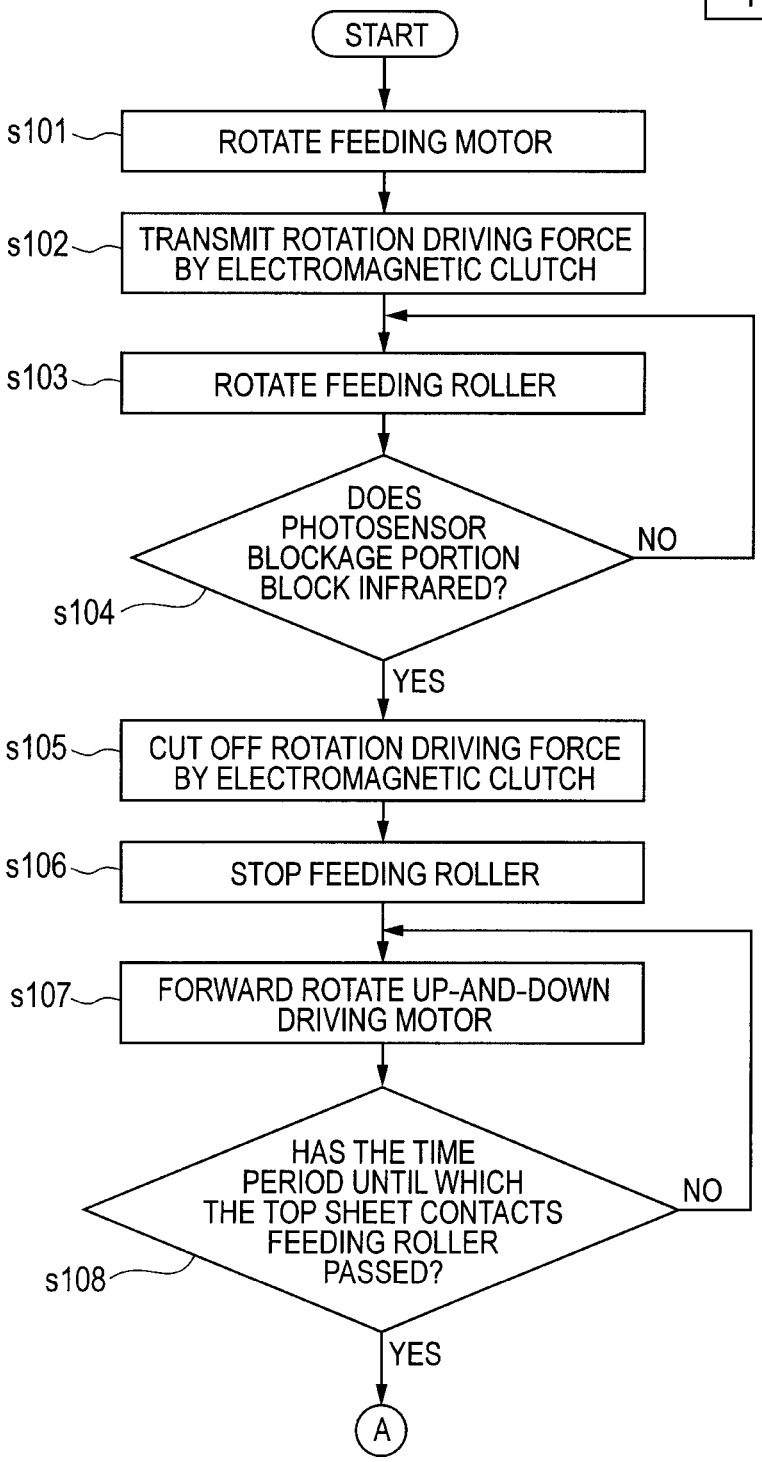
FIG. 8 which is comprised of FIGS. 8A and 8B are flowcharts illustrating a sheet feeding operation of the sheet-feeding portion according to the first embodiment.
Figure 8B:
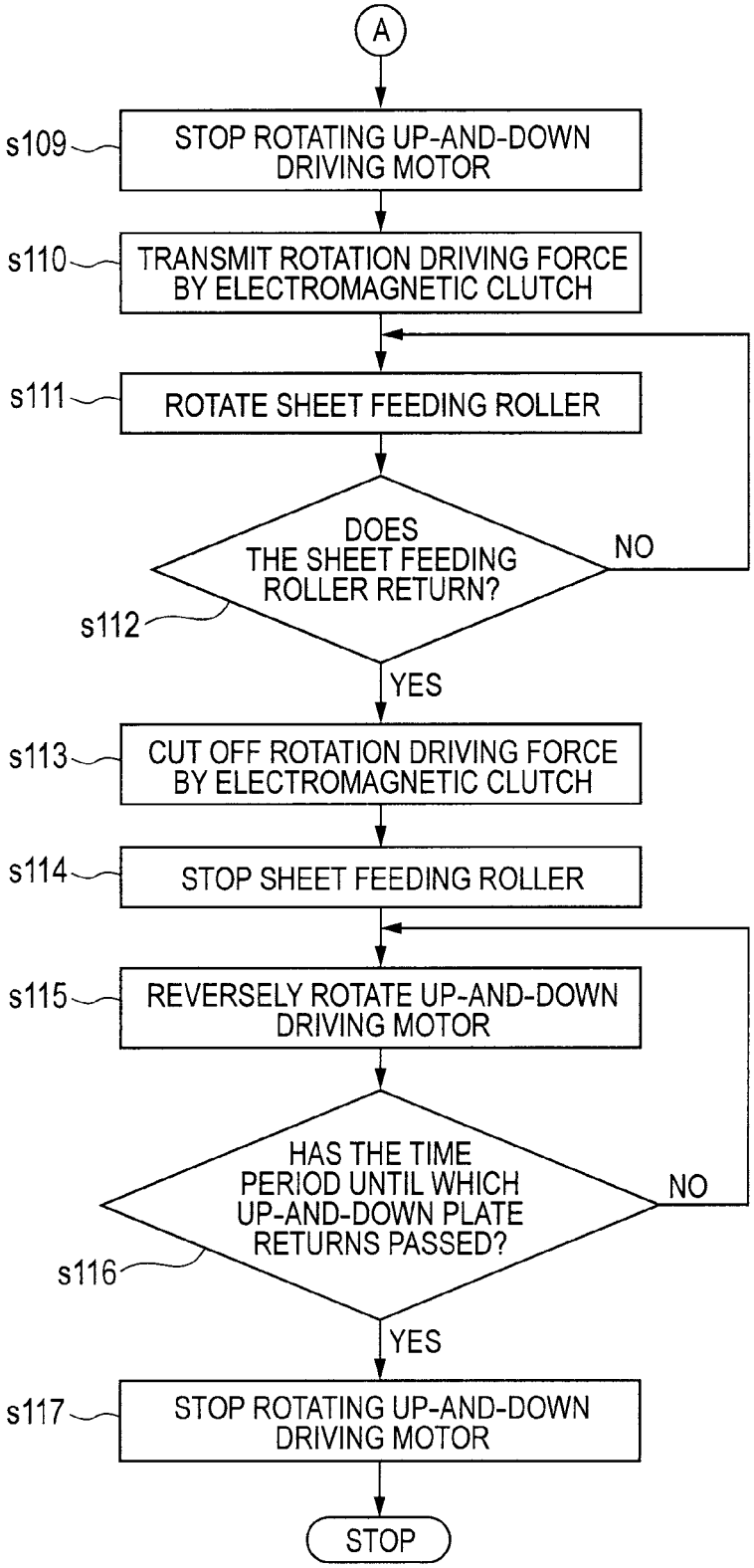

Next, according to the flowchart illustrated in FIGS. 8A and 8B, referring to FIGS. 5A to 7B in addition to FIGS. 2A and 2B, a feeding operation by the sheet-feeding portion 50 is described. FIG. 5A is a perspective view illustrating a state where the tip of the friction portion 15*a* of the sheet-feeding portion 50 of the first embodiment rotates to the contact position. FIG. 5B is a side view of the sheet-feeding portion 50 illustrated in FIG. 5A. FIG. 6A is a perspective view illustrating a state where the sheet supporting portion 3 of the sheet-feeding portion 50 according to the first embodiment moves up and the friction portion 15*a* and the sheet S are in connection with each other. FIG. 6B is a side view of the sheet-feeding portion 50 illustrated in FIG. 6A. FIG. 7A is a perspective view illustrating a state where the friction portion 15*a* of the sheet-feeding portion 50 according to the first embodiment has fed the sheet S1. FIG. 7B is a side view illustrating the sheet-feeding portion 50 illustrated in FIG. 7A. FIGS. 8A and 8B are flowcharts illustrating the sheet feeding operation of the sheet-feeding portion 50 according to the first embodiment. Note that, in FIGS. 5B, 6B and 7B, portions nearer than the feeding follower roller 18 are not illustrated for facilitating clear illustration of the friction portion 15*a* of the feeding roller 15.

The positions illustrated in FIGS. 2A and 2B are the initial positions of the feeding roller 15 (friction portion 15*a*), the flag 16 (photo sensor blockage portion 16*a*), the sheet supporting portion 3 and the sheet supporting portion cam 6. At the initial position, when a drive signal from the control part 70 is input into the feeding motor, not illustrated, the feeding motor rotates and a drive train, not illustrated, transmits a rotation driving force to the gear 13. This transmission allows the gear 13 to start rotating in the direction of the arrow R8 illustrated in FIG. 2B (step S101). Next, a signal from the control part 70 is input into the electromagnetic clutch 12, and the electromagnetic clutch 12 transmits the rotation driving force from the gear 13 to the gear 14 (step S102). With transmission of rotation driving force to the gear 14, the gear 14 starts to rotate in the direction of arrow R8, and the feeding gear 11, the feeding shaft 10, the flag 16 and the feeding roller 15 rotate in the direction of arrow R1 (step S103).

(Operation in which Feeding Roller 15 Temporarily Stops Rotating)

As illustrated in FIGS. 5A and 5B, when the feeding gear 11, the feeding shaft 10, the flag 16 and the feeding roller 15 rotate in the direction of arrow R1 by the angle θ1 illustrated in FIGS. 2A and 2B, the tip of the friction portion 15*a* of the feeding roller 15 reaches a position which is the contact position P2 and at which the tip is in contact with the separation pad 19. Here, when the photo sensor blockage portion 16*a* rotates by the angle θ1, the infrared light passage 17*a* is blocked by the photo sensor blockage portion 16*a*. The infrared light passage 17*a* is thus blocked by the photo sensor blockage portion 16*a*, and the infrared light passage 17*a* transmits a prescribed signal to the control part 70. When the prescribed signal transmitted from the infrared light passage 17*a* is input into the control part 70, the control part 70 blocks the signal to the electromagnetic clutch 12 (steps S104 and 105). The signal to the electromagnetic clutch 12 is thus blocked, and the electromagnetic clutch 12 does not transmit the rotation driving force from the gear 13 to the gear 14. The gear 14, the feeding gear 11, the feeding shaft 10, the flag 16 and the feeding roller 15 stop the rotation (step S106).

(Operation of Sheet Supporting Portion 3 and Flow Up to Feeding Start Operation)

When the prescribed signal transmitted from the infrared light passage 17*a* is input into the control part 70, the drive signal from the control part 70 is input into the sheet supporting portion drive motor, not illustrated, and the gear 9 rotates in the direction of arrow R6 as illustrated in FIGS. 6A and 6B. The gear 9 thus rotates in the direction of arrow R6, the sheet supporting portion gear 8, the sheet supporting portion cam shaft 7 and the sheet supporting portion cam 6 rotate in the direction of arrow R4 (step S107).

Here, the rotational direction in which the gear 9 rotates in the direction of arrow R6 is the positive direction of the rotational direction of the sheet supporting portion drive motor. The opposite direction is the inverse direction. With rotation of the sheet supporting portion cam 6 in the direction of arrow R4, the sheet supporting portion 3 is subjected to an urging force from the feeding spring 5 to rotate in the direction of arrow R2. The sheet stack T is supported on the sheet supporting portion 3. The sheet S at the top surface of the sheet stack T abuts on the friction portion 15*a* of the feeding roller 15, thereby stopping the rotation. The control part 70 controls the sheet supporting portion drive motor for a prescribed time in which the sheet S of the sheet stack T abuts on the friction portion 15*a* of the feeding roller 15 (steps S108 and S109). That is, the timer 71 measures the prescribed time, and the control part 70 rotates the sheet supporting portion drive motor based on the time measured by the timer 71.

When the sheet S at the top surface of the sheet stack T supported on the sheet supporting portion 3 abuts on the friction portion 15*a* of the feeding roller 15, the signal from the control part 70 is input into the electromagnetic clutch 12, the electromagnetic clutch 12 transmits the rotation driving force from the gear 13 to the gear 14 (step S110). The rotation driving force is thus transmitted to the gear 14, and the gear 14 rotates in the direction of arrow R8 and the feeding gear 11, the feeding shaft 10, the flag 16 and the feeding roller 15 rotate in the direction of arrow R1 (step S111). Thus, the friction portion 15*a* of the feeding roller 15 feeds the sheet S at the top surface of the sheet stack T by a frictional force with the sheet S at the top surface.

(Operation at Stop of Feeding Operation)

Next, the timer measures the time in which the feeding gear 11, the feeding shaft 10, the flag 16 and the feeding roller 15 rotate in the direction of arrow R1 by the angle θ2 illustrated in FIG. 3. After a prescribed time has passed, the control part 70 blocks the signal of the electromagnetic clutch 12. The signal of the electromagnetic clutch 12 is blocked, the electromagnetic clutch 12 terminates transmission of the rotation driving force from the gear 13 to the gear 14 (steps S112 and S113). Accordingly, as illustrated in FIGS. 7A and 7B, the gear 14, the feeding gear 11, the feeding shaft 10, the flag 16 and the feeding roller 15 stop the rotation and maintains the state at the initial position (step S114).

Likewise, the drive signal from the control part that inversely rotates the sheet supporting portion drive motor in the inverse direction is input, and the sheet supporting portion drive motor rotates the gear 9 in the direction of arrow R7. The sheet supporting portion drive motor thus rotates the gear 9 in the direction of arrow R7, and the sheet supporting portion gear 8, the sheet supporting portion cam shaft 7 and the sheet supporting portion cam 6 start rotating in the direction of the arrow R5 (step S115). The sheet supporting portion cam thus rotates in the direction of arrow R5, thereby pushing down the sheet supporting portion 3 in the direction of arrow R3. The timer 71 measures the time in which the sheet supporting portion cam 6 and the sheet supporting portion 3 return to the initial position. After a prescribed time has passed, the control part 70 stops the sheet supporting portion drive motor and thereby the gear 9, the sheet supporting portion gear 8, the sheet supporting portion cam shaft 7 and the sheet supporting portion cam 6 stop at the initial position. That is, the state returns to the state illustrated in FIGS. 2A and 2B and the sheet feeding control is finished (steps S116 and S117).

Figure 9A:
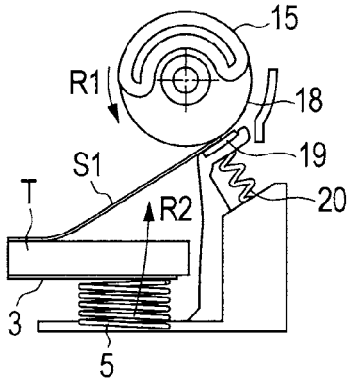
FIG. 9A is a diagram illustrating a state where the sheet is sandwiched between a feeding follower roller and a separation pad.
Figure 9B:
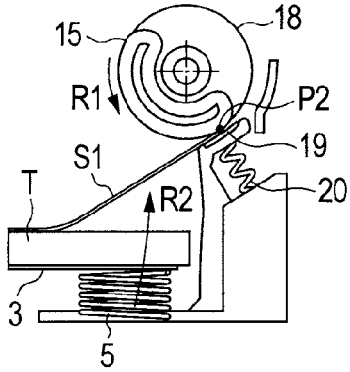
FIG. 9B is a diagram illustrating a state where the tip of the friction portion is in contact with the sheet at a contact position P2.
Figure 9C:
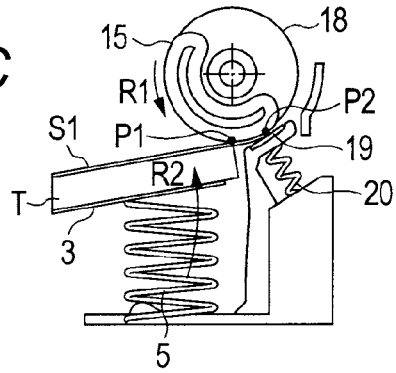
FIG. 9C is a diagram illustrating a state where the friction portion is in contact with the sheet at an abutting position P1 and the contact position P2.
Figure 9D:
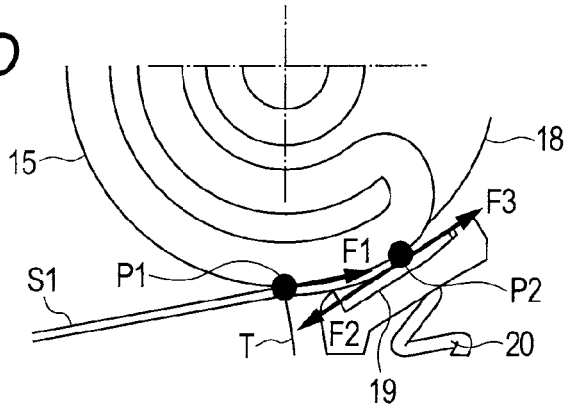
FIG. 9D is a partially enlarged view of FIG. 9C.

Such sheet feeding control is repeated. Accordingly, the sheet stack T stacked on the feeding tray 2 is separated on a sheet-by-sheet basis for each rotation of the feeding roller 15 and the separated sheet is fed. Here, prevention of buckling by the operation of the feeding control in a step of feeding the sheet S1 dragged (subjected to double feeding) in the immediately preceding step is described with reference to FIGS. 9A to 9D. FIG. 9A is a diagram illustrating a state where the sheet S1 is sandwiched between the feeding follower roller 18 and the separation pad 19. FIG. 9B is a diagram illustrating a state where the tip of the friction portion 15*a* abuts on the sheet S1 at the abutting position P1. FIG. 9C is a diagram illustrating a state where the friction portion 15*a* is in contact with the sheet S1 at the abutting position P1 and the contact position P2. FIG. 9D is a partially enlarged view of FIG. 9C.

As illustrated in FIG. 9A, among the sheets S1 dragged in the immediately previous feeding step, only the sheet S at the top surface is fed by the separation pad 19. Accordingly, the tip remains in the nip between the separation pad 19 and the feeding follower roller 18. In this state, when the drive signal from the control part 70 is input into the feeding motor, not illustrated, and feeding is started, the operations of steps S101 to S106 are started. Accordingly, the feeding roller 15 stops at the contact position P2 where the tip of the friction portion 15*a* abuts on the tip of the sheet S1 (see FIG. 9B). At this time, while the tip of the sheet S1 is sandwiched in the nip of the separation pad 19 and the feeding follower roller 18, the sheet is not fed until the tip of the friction portion 15*a* abuts but is held at the contact position P2.

Next, the operations in steps S107 to S109 are operated, the sheet supporting portion 3 moves up, the sheet S1 is pressed by the sheet stack T supported on the sheet supporting portion 3 and the sheet S1 abuts on the feeding roller 15 (see FIG. 9C). The position at this time where the feeding roller 15 and the sheet S1 abut on each other is the abutting position P1 as a push position. The operations in the aforementioned steps S110 and S111 are performed, and the feeding roller 15 starts rotating in the direction of arrow R1. As illustrated in FIG. 9D, the sheet S1 at this time is subjected to frictional forces at the abutting position P1 where the sheet stack T moves up and abuts and the contact position P2, which is the contact position of the tip of the friction portion 15*a* of the feeding roller 15 and the tip of the sheet S1.

Thus, the sheet S1 is subjected to the frictional force from the friction portion 15*a* of the feeding roller in the direction of the arrow F1 at the abutting position P1 and the frictional force from the friction portion 15*a* of the feeding roller 15 in the direction of the arrow F3 at the contact position P2, and thereby this sheet is fed. Accordingly, even in the case where the sheet S1 is subjected to the frictional force in the direction of the arrow F2 from the separation pad 19, feeding of the sheet S1 by the frictional force in the direction of the arrow F3 at the contact position P2 can suppress occurrence of buckling in proximity of the tip of the sheet S1. Subsequently, the operations in steps S112 to S117 are performed on the sheet S1, and the operation of the sheet feeding control is finished.

The image forming apparatus 1 according to the first embodiment that have the aforementioned configuration exerts following advantageous effects. The sheet-feeding portion 50 of the image forming apparatus 1 according to the first embodiment causes the sheet supporting portion 3 to wait until the feeding roller 15 reaches the separation pad 19. After the feeding roller 15 reaches the separation pad 19, the sheet supporting portion 3 moves up to contact the sheet with the feeding roller 15. Accordingly, even if the phenomenon of dragging the sheet S1 in the immediate preceding feeding step drags the sheet S1 on the separation pad 19, the sheet S1 can be fed in the state of contact at the two points, which are the abutting position P1 and the contact position P2. Such contact can suppress occurrence of buckling caused by the sheet dragging phenomenon even if a thin sheet with a low rigidity (low basic weight) is used. As a result, stable feeding while suppressing occurrence of feeding failure can be realized. A highly reliable image forming apparatus can be provided.

For instance, occurrence of the buckling of the sheet S1 can be suppressed without addition of a mechanism for returning the dragged sheet S1. A sheet feeding apparatus that is compact and low cost and has high feeding stability can be provided.

<Second Embodiment>

Next, an image forming apparatus 1A according to a second embodiment of the present invention is described with reference to FIGS. 10A, 10B and 10C to FIGS. 15A and 15B. The second embodiment rotates the feeding shaft 10 at a uniform velocity and temporarily stops the feeding roller without complicated control. That is, the image forming apparatus 1A according to the second embodiment is different from the apparatus in the first embodiment; the apparatus in the second embodiment controls stopping the rotation of the feeding roller 15 when the friction portion 15*a* reaches the separation pad 19, using the temporary stop mechanism. Accordingly, on the second embodiment, the difference which is the temporary stop mechanism of the feeding roller 15 is mainly described. The identical symbols are assigned to components having the configuration analogous to the configuration of the image forming apparatus 1 according to the first embodiment. The description thereof is omitted. In the second embodiment, the components having the configuration analogous to the components of the first embodiment exert advantageous effects analogous to the effects of the first embodiment.

Figure 10A:
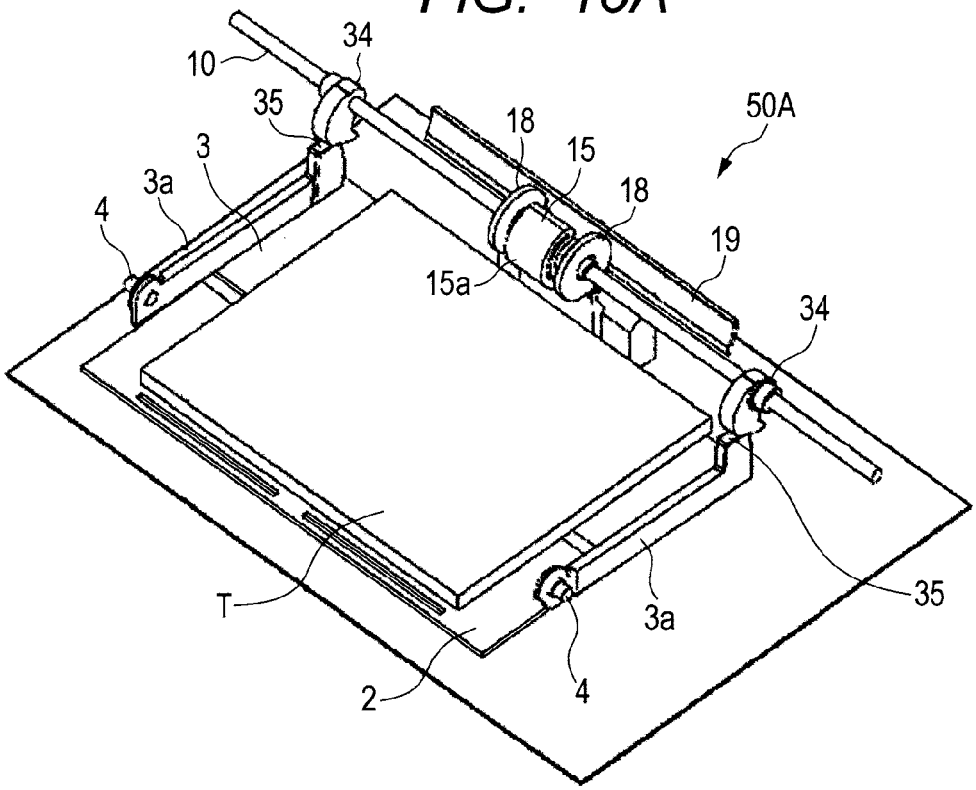
FIG. 10A is a perspective view illustrating a state where the tip of the friction portion of the sheet-feeding portion according to a second embodiment rotates.
Figure 10B:
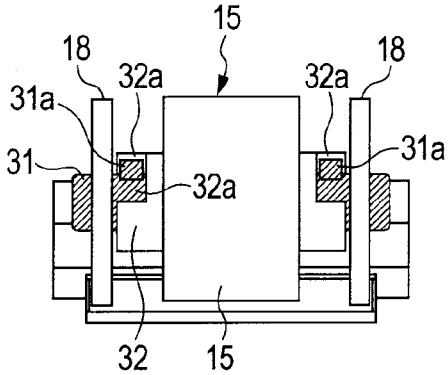
FIG. 10B is a front view of the sheet-feeding portion illustrated in FIG. 10A.
Figure 10C:
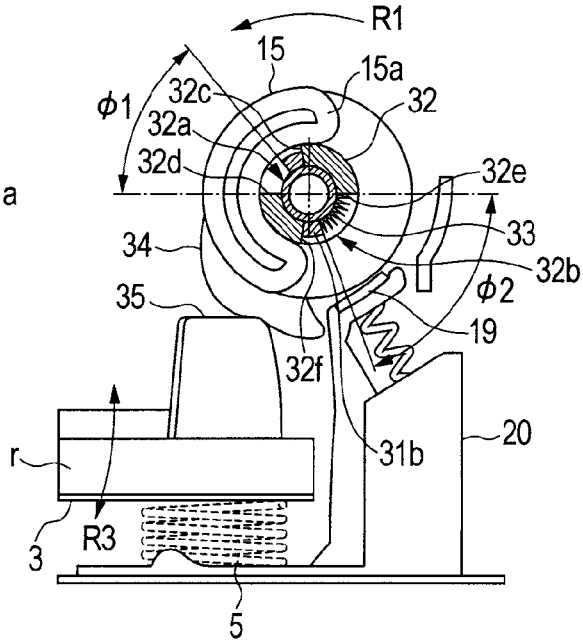
FIG. 10C is a partially enlarged side view of the sheet-feeding portion illustrated in FIG. 10A.

First, an overall configuration of a sheet-feeding portion 50A according to the second embodiment is described with reference to FIGS. 10A and 10B. FIG. 10A is a perspective view illustrating a state where the tip of the friction portion 15*a* of the sheet-feeding portion 50A according to the second embodiment rotates. FIG. 10B is a partially enlarged front view of the sheet-feeding portion 50A illustrated in FIG. 10A. FIG. 10C is a partially enlarged side view of the sheet-feeding portion 50A illustrated in FIG. 10A.

As illustrated in FIGS. 10A to 10C, the temporary stop mechanism includes a feeding shaft holder 31 as a first rotary member fixed to the feeding shaft 10, a feeding roller holder 32 as a second rotary member swingably supported by the feeding shaft holder 31, and an urging spring 33. The feeding shaft holder 31 includes a first protrusion 31*a* protruding from the outer circumferential surface, and a second protrusion 31*b*. The feeding roller holder 32 includes a first notch 32*a* at which the first protrusion 31*a* is exposed, and a second notch 32*b* at which the second protrusion 31*b* is exposed. The first notch 32*a* includes a first abutting surface 32*c* that abuts on the first protrusion 31*a* when the feeding roller holder 32 rotates in the direction of arrow R1, and a second abutting surface 32*d* that abuts on the first protrusion 31*a* when the feeding roller holder 32 rotates in the direction opposite to the direction of arrow R1. Likewise, the second notch 32*b* includes a connection surface 32*e* connected with one end of the urging spring 33, and an abutting surface 32*f* that abuts on the second protrusion 31*b* when the feeding roller holder 32 rotates in the direction of arrow R1. The feeding roller 15 is connected to the feeding roller holder 32.

The urging spring 33 is a compressed spring intervening between the second protrusion 31*b* and the feeding roller holder 32 in the second notch 32*b* of the feeding roller holder 32. The urging spring 33 urges the feeding roller holder 32 in the direction of arrow R1, and causes the feeding roller holder 32 to rotate in coordination with the feeding shaft holder 31. Here, as illustrated in FIG. 10C, provided that the angle between the second abutting surface 32*d* of the first notch 32*a* and the first protrusion 31*a* is an angle $\theta 1$ and the angle between the abutting surface 32*f* of the second notch 32*b* and the second protrusion 31*b* is an angle $\phi 2$, the angle $\phi 2$ is larger than the angle $\phi 1$. The angles $\phi 1$ and $\phi 2$ are variable in the swingable range of the feeding roller holder 32. In the initial state, provided that $\phi=\phi 3$, with $\phi 3 \geq \phi 1 > 0$, the urging force of the urging spring 33 urges the feeding roller holder 32. At $\phi 1=0$, the feeding shaft holder 31 abuts on the second abutting surface 32*d*, thereby urging the feeding roller holder 32 with a larger force.

The urging force of the urging spring 33 urging the feeding roller holder 32 is set such that, when the frictional force is caused between the friction portion 15*a* of the feeding roller 15 and the separation pad 19, the feeding roller 15 and the feeding roller holder 32 cannot rotate.

The feeding cams 34 as cam members are fixed at the opposite ends of the feeding shaft 10, slidingly contact with cams 35 formed at the cam followers 3*a* of the sheet supporting portion 3, and configure the elevating unit that moves the sheet supporting portion 3 up and down against the urging force of the feeding spring 5. The feeding cam 34 has a configuration according to which the sheet supporting portion 3 swingably moves at one reciprocation in the directions of arrows R2 and R3.

Figure 11A:
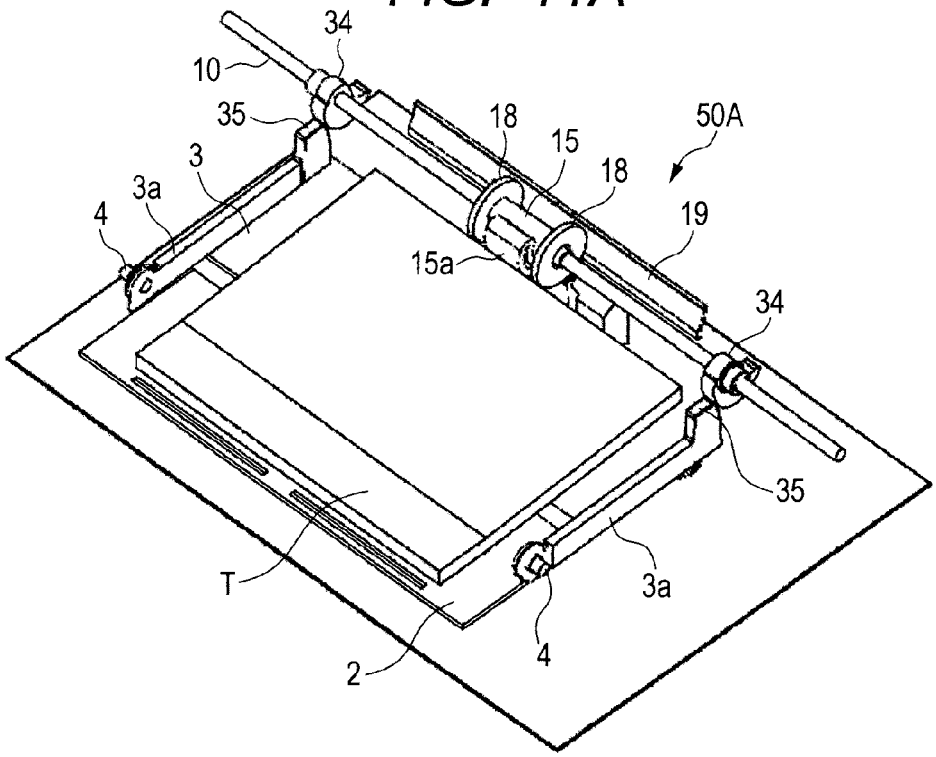
FIG. 11A is a perspective view illustrating a state where the tip of the friction portion of the sheet-feeding portion according to the second embodiment rotates to the contact position.
Figure 11B:
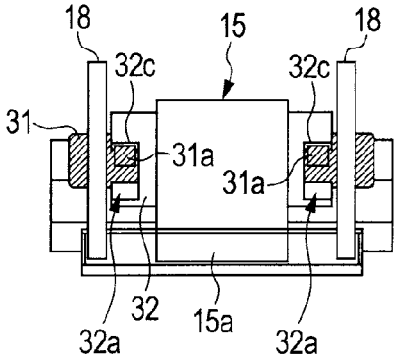
FIG. 11B is a partially enlarged front view of the sheet-feeding portion illustrated in FIG. 11A.
Figure 11C:
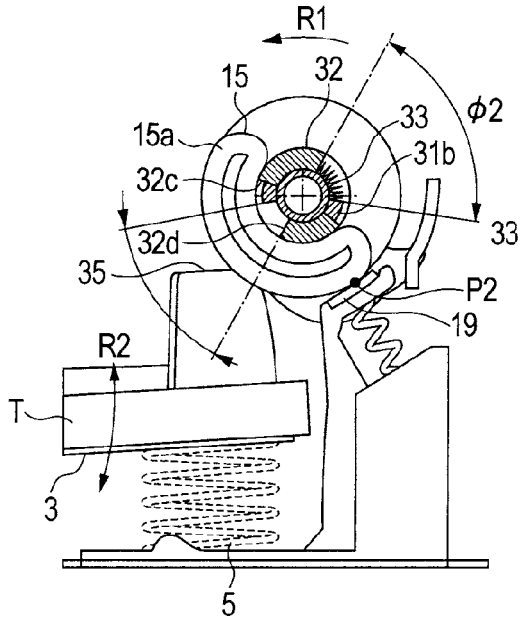
FIG. 11C is a partially enlarged side view of the sheet-feeding portion illustrated in FIG. 11A.
Figure 12A:
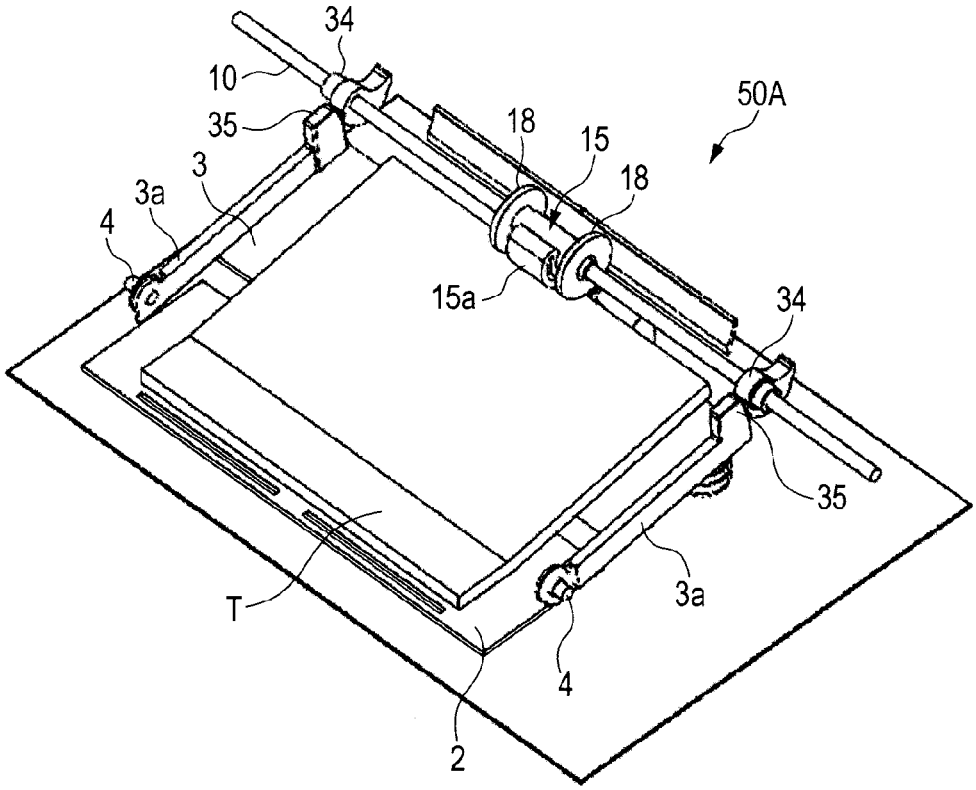
FIG. 12A is a perspective view illustrating a state where the sheet supporting portion of the sheet-feeding portion according to the second embodiment moves up to contact the friction portion and the sheet stack.
Figure 12B:
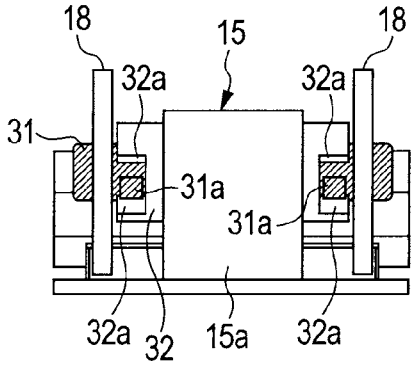
FIG. 12B is a partially enlarged front view of the sheet-feeding portion illustrated in FIG. 12A.
Figure 12C:
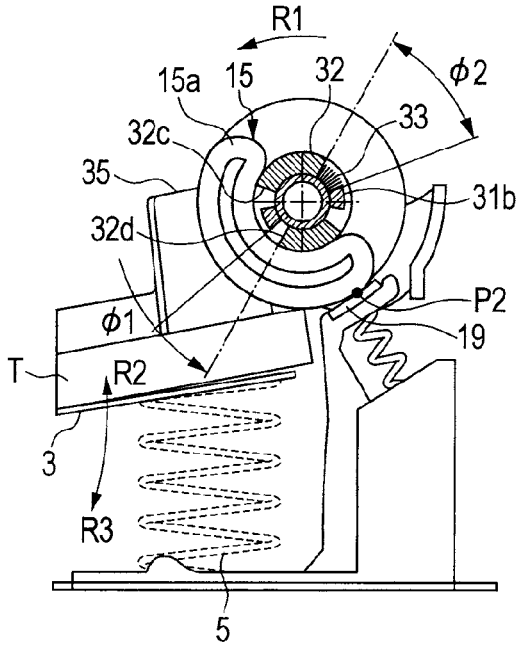
FIG. 12C is a partially enlarged side view of the sheet-feeding portion illustrated in FIG. 12A.
Figure 13A:
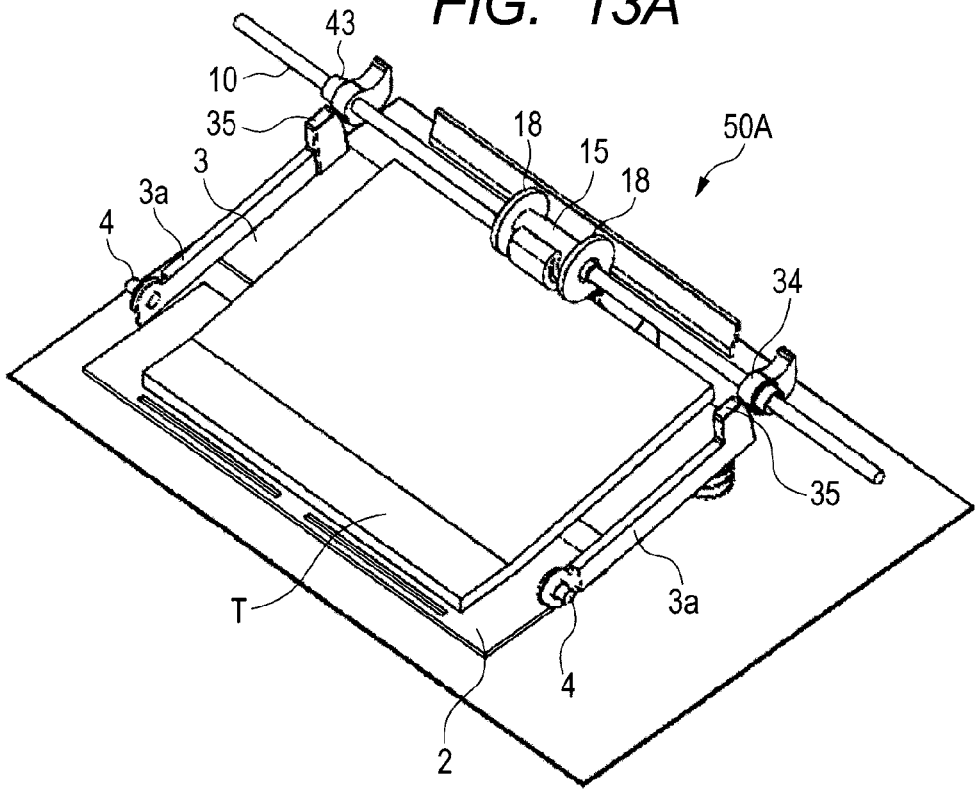
FIG. 13A is a perspective view illustrating a state where an urging spring of the sheet-feeding portion according to the second embodiment is compressed.
Figure 13B:
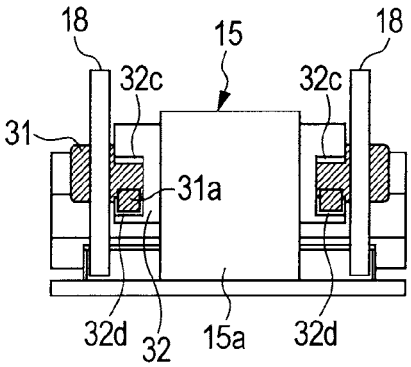
FIG. 13B is a partially enlarged front view of the sheet-feeding portion illustrated in FIG. 13A.
Figure 13C:
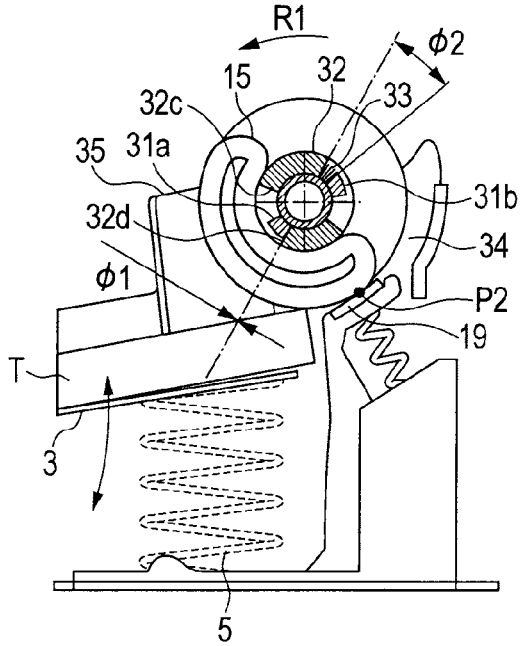
FIG. 13C is a partially enlarged side view of the sheet-feeding portion illustrated in FIG. 13A.
Figure 14A:
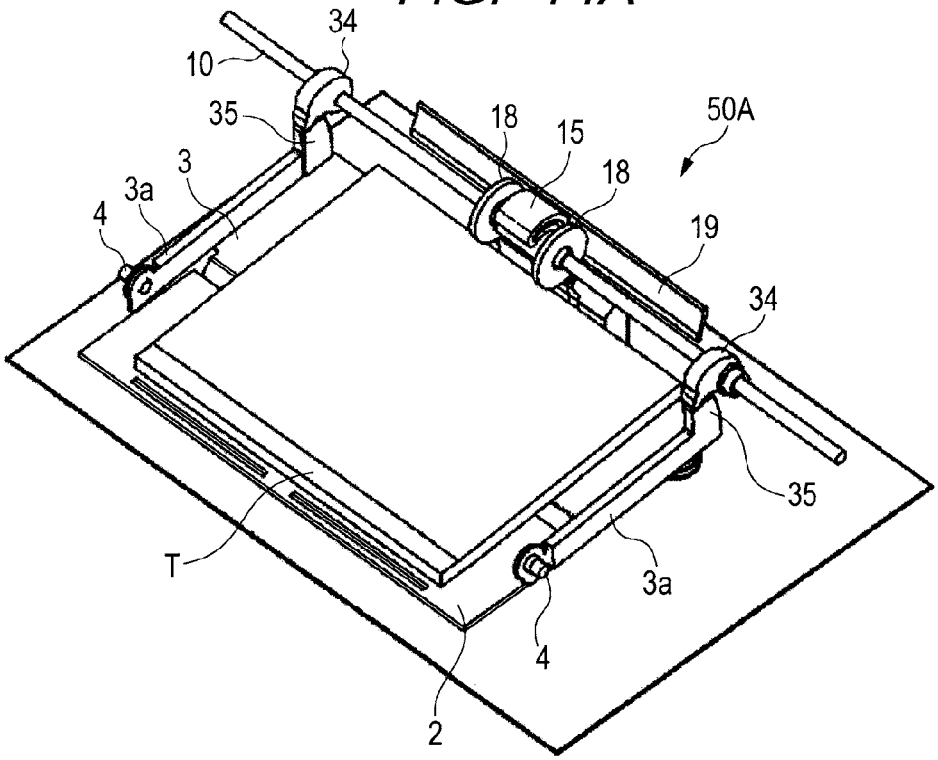
FIG. 14A is a perspective view illustrating a state where the friction portion of the sheet-feeding portion according to the second embodiment feeds a sheet.
Figure 14B:
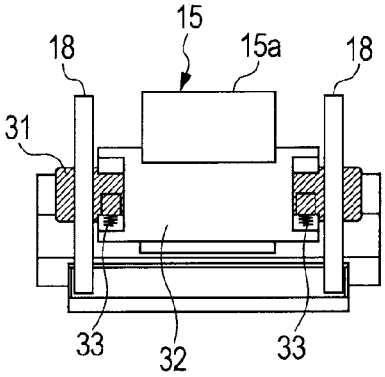
FIG. 14B is a partially enlarged front view of the sheet-feeding portion illustrated in FIG. 14A.
Figure 14C:
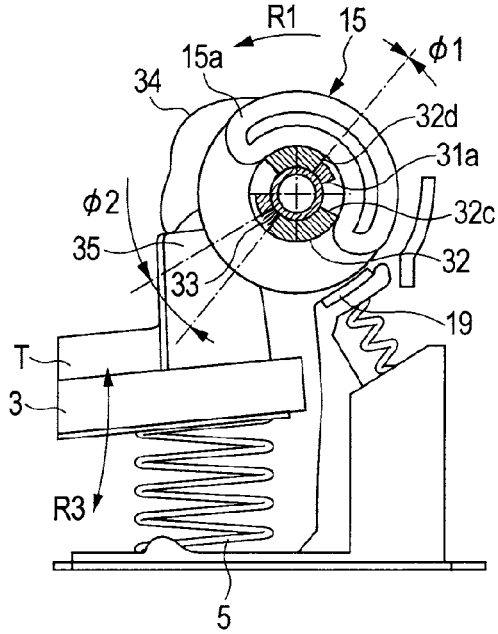
FIG. 14C is a partially enlarged side view of the sheet-feeding portion illustrated in FIG. 14A.

Next, sheet feeding control for the sheet-feeding portion 50A according to the second embodiment is described with reference to FIGS. 11A and 14C in addition to FIGS. 10A to 10C. FIG. 11A is a perspective view illustrating a state where the tip of the friction portion 15*a* of the sheet-feeding portion 50A according to the second embodiment rotates to the contact position. FIG. 11B is a partially enlarged front view of the sheet-feeding portion 50A illustrated in FIG. 11A. FIG. 11C is a partially enlarged side view of the sheet-feeding portion 50A illustrated in FIG. 11A. FIG. 12A is a perspective view illustrating a state where the sheet supporting portion 3 of the sheet-feeding portion 50A according to the second embodiment moves up and the friction portion 15*a* and the sheet stack T abut on each other. FIG. 12B is a partially enlarged front view of the sheet-feeding portion 50A illustrated in FIG. 12A. FIG. 12C is a partially enlarged side view of the sheet-feeding portion 50A illustrated in FIG. 12A. FIG. 13A is a perspective view illustrating a state where the urging spring 33 of the sheet-feeding portion 50A according to the second embodiment is compressed. FIG. 13B is a partially enlarged front view of the sheet-feeding portion 50A illustrated in FIG. 13A. FIG. 13C is a partially enlarged side view of the sheet-feeding portion illustrated in FIG. 13A. FIG. 14A is a perspective view illustrating where the friction portion 15*a* of the sheet-feeding portion 50A according to the second embodiment has fed the sheet S. FIG. 14B is a partially enlarged front view of the sheet-feeding portion 50A illustrated in FIG. 14A. FIG. 14C is a partially enlarged side view of the sheet-feeding portion 50A illustrated in FIG. 14A.

The positions illustrated in FIGS. 10A to 10C are the initial positions of the feeding roller 15 (friction portion 15*a*), the feeding shaft holder 31, the feeding roller holder 32, the sheet supporting portion 3 and the feeding cam 34. At the initial position, when the drive signal from the control part, not illustrated, is input into the feeding motor as a driving source, not illustrated, the feeding motor rotates and the rotation driving force is transmitted from a drive train, not illustrated, to the gear that is not illustrated and fixedly supported by the feeding shaft 10. Accordingly, the rotation driving force in the direction of arrow R1 is transmitted to the feeding shaft 10, and the feeding shaft holder 31 fixed to the feeding shaft 10 and the feeding cam 34 rotate in the direction of arrow R1. When the feeding shaft holder 31 thus rotates in the direction of arrow R1, the feeding roller holder 32 is subjected to the urging force of the urging spring 33 in the direction of arrow R1 and the first protrusion 31*a* of the feeding shaft holder 31 and the first abutting surface 32*c* rotate in the direction of arrow R1 while abutting on each other (see FIG. 10C). Likewise, when the feeding cam 34 rotates in the direction of arrow R1, the sheet supporting portion 3 is subjected to the urging force from the feeding spring 5 in the direction of arrow R2 and the sheet supporting portion 3 rotates in the direction of arrow R2.

(Operation of Feeding Roller 15 Temporarily Stopping Rotation)

As illustrated in FIGS. 11A to 11C, when the feeding roller 15 and the feeding roller holder 32 rotate in the direction of arrow R1 and the tip of the friction portion 15*a* of the feeding roller 15 reaches the contact position P2, the friction portion 15*a* is subjected to the frictional force from the separation pad 19 and the feeding roller 15 stops. Here, until the feeding roller 15 stops, the first protrusion 31*a* and the abutting surface 32*c* rotate in the direction of arrow R1 while abutting on each other by being urged by the urging spring 33. Accordingly, the feeding shaft holder 31 and the feeding roller holder 32 rotate in the direction of arrow R1 in coordination with each other. On the other hand, as described above, the urging force of the urging spring 33 is set such that, when the frictional force is caused between the friction portion 15*a* of the feeding roller 15 and the separation pad 19, the feeding roller 15 and the feeding roller holder 32 cannot rotate. Therefore, even if the angle $\theta 2$ becomes small and the urging force of the urging spring 33 becomes larger, the feeding roller 15 becomes in the state of keeping stopping at the contact position P2 against the urging force of the urging spring 33 by the frictional force caused between the friction portion 15*a* and the separation pad 19. That is, the coordination between the feeding shaft holder 31 and the feeding roller holder 32 is canceled.

(Operation of Sheet Supporting Portion 3 and Operation Until Start of Feeding)

As illustrated in FIGS. 12A to 12B, if the feeding roller holder 32 and the feeding roller 15 stop by the frictional force with the separation pad 19, the feeding shaft 10, the feeding shaft holder 31 and the feeding cam 34 continue to rotate in the direction of arrow R1. Accordingly, by the rotation of the feeding cam 34, the feeding cam 34 slides with the cam 35 formed on the cam follower 3*a* of the sheet supporting portion 3, and the sheet stack T supported on the sheet supporting portion 3 moves up. When the sheet S at the top surface of the sheet stack T abuts on the friction portion 15*a* of the feeding roller 15, the sheet supporting portion 3 stops.

As illustrated in FIGS. 13A to 13C, after the sheet supporting portion 3 is stopped, if the feeding shaft holder 31 continues to rotate in the direction of arrow R1, the angle becomes θ1=0°. That is, the first protrusion 31*a* of the feeding shaft holder 31 abuts on the first abutting surface 32*d*. Accordingly, the feeding roller holder 32 and the feeding roller 15 are pressed in the direction of arrow R1, and start to rotate again. The friction portion 15*a* of the feeding roller 15 is pressed against the sheet S at the top surface of the sheet supporting portion 3, and feeding of the sheet S is restarted. Here, the urging spring 33 returns at the timing when the sheet supporting portion 3 reaches the abutting position P1.

(Operation when Feeding Operation is Finished)

As illustrated in FIGS. 14A to 14C, the feeding shaft 10, the feeding shaft holder 31, the feeding roller holder 32, the feeding roller 15 and the feeding cam 34 continue to rotate in the direction of arrow R1, and the feeding cam 34 abuts on the cam 35 to thereby press down the sheet supporting portion 3 in the direction of arrow R3. Accordingly, the sheet supporting portion 3 returns to the initial position illustrated in FIG. 10C. When the sheet supporting portion 3 returns to the initial position, the solenoid which is not illustrated is engage with the gear which is not illustrated and fixedly supported by the feeding shaft 10 to thereby terminate transmission of the rotation driving force to the feeding shaft 10. Accordingly, the feeding shaft 10, the feeding shaft holder 31 and the feeding cam 34 stop at the respective initial positions.

At the initial position, the feeding roller holder 32 is subjected to the urging force from the urging spring 33 in the direction of arrow R1. Accordingly, the first abutting surface 32*c* of the feeding roller holder 32 abuts on the first protrusion 31*a* of the feeding shaft holder 31. Thus, the feeding roller 15 returns to the initial position illustrated in FIGS. 10A to 10C, and the operation of the sheet-feeding portion is completed. The feeding roller 15 returns to the initial position by the urging force of the urging spring 33. Accordingly, the feeding roller 15 when the transmission of the rotation driving force to the feeding shaft 10 is terminated is in place downstream of the sheet feeding direction where the rear end of the friction portion 15*a* has passed the separation pad 19 so as not to be affected by the frictional force of the separation pad 19.

By repeating the operation, the sheet S stacked on the feeding tray 2 is separated and fed one by one for each rotation of the feeding roller 15.

Figure 15A:
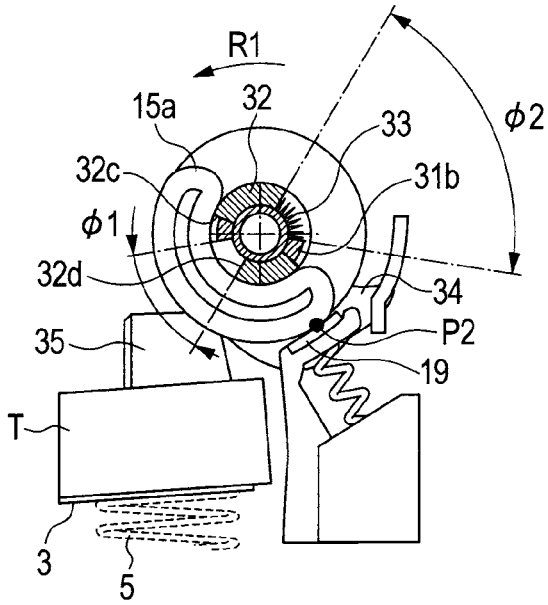
FIG. 15A is a sectional view illustrating proximity of the feeding roller when the amount of sheets supported on the sheet supporting portion becomes the maximum.
Figure 15B:
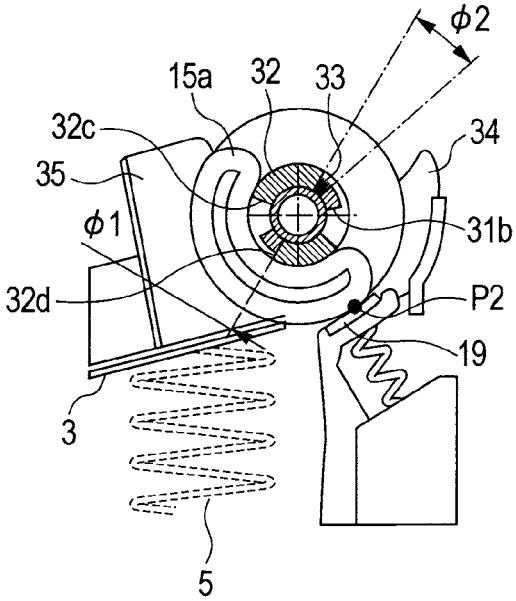
FIG. 15B is a sectional view illustrating proximity of the feeding roller when the amount of sheets supported on the sheet supporting portion becomes the minimum.
Figure 16A:
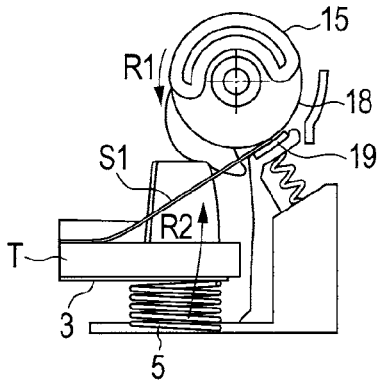
FIG. 16A is a diagram illustrating a state where a sheet fed by a sheet-feeding portion of a conventional image forming apparatus is sandwiched between a feeding follower roller and a separation pad.
Figure 16B:
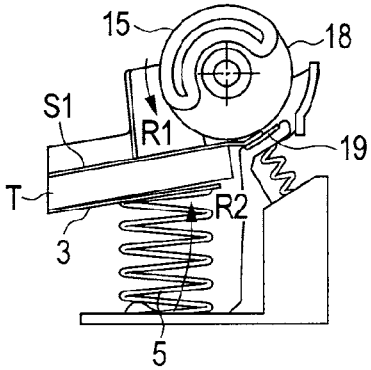
FIG. 16B is a diagram illustrating a state where a feeding roller rotates.
Figure 16C:
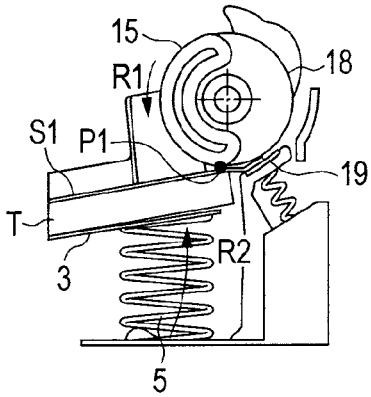
FIG. 16C is a diagram illustrating a state where the feeding roller contacts with the sheet at an abutting position P1.
Figure 16D:
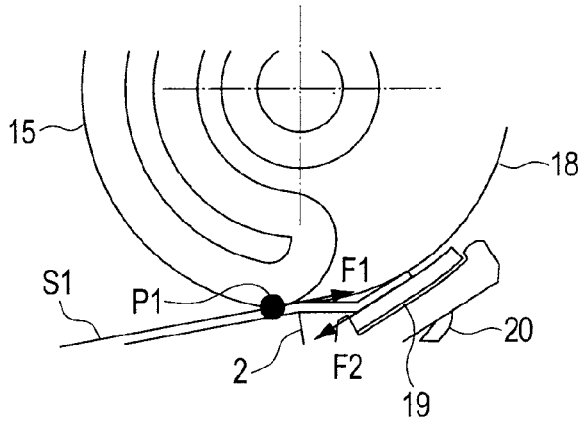
FIG. 16D is a partially enlarged view of FIG. 16C.

Here, referring to FIGS. 15A and 15B, the cam surface formation condition of the feeding cam 34 is described. FIG. 15A is a sectional view illustrating proximity of the feeding roller 15 in a case where the amount of sheets S supported on the sheet supporting portion 3 is the maximum. FIG. 15B is a sectional view illustrating proximity of the feeding roller 15 in a case where the amount of sheets S supported on the sheet supporting portion 3 is the minimum.

FIG. 15A illustrates a state where the friction portion 15*a* is positioned at the contact position P2 in the case where the amount of sheet stacks T on the sheet supporting portion 3 is the maximum. In this state, the cam surfaces of the feeding cam 34 and the cam 35 are formed such that, before the sheet S at the top surface of the sheet stack T abuts on the friction portion 15*a* of the feeding roller 15, the tip of the friction portion 15*a* of the feeding roller 15 abuts on the separation pad 19 and stops by the frictional force. This state is referred to as a cam surface formation condition 1.

FIG. 15B illustrates a state where, when the sheet S is not supported on the sheet supporting portion 3, the friction portion 15*a* is positioned at the contact position P2. In this state, the value θ3 is set and the cam surfaces of the feeding cam 34 and the cam 35 are formed such that, after the sheet supporting portion 3 abuts on the feeding roller 15 that is stopped at the contact position P2, the feeding roller 15 starts to rotate again. This state is referred to as a cam surface formation condition 2.

Thus, by defining the cam surfaces of the feeding cam 34 and the cam 35 according to the cam surface formation conditions 1 and 2, the sheet S of the sheet supporting portion 3 can abut on the feeding roller 15, while the friction portion 15*a* stops at the contact position P2, irrespective of the amount of stacks of sheets S.

The image forming apparatus 1A according to the second embodiment having the aforementioned configuration exerts following advantageous effects. The sheet-feeding portion 50A of the image forming apparatus 1A according to the second embodiment includes the temporary stop mechanism. When the friction portion 15*a* reaches the separation pad 19, the mechanism stops the rotation of the feeding roller 15. When the elevating portion 3 rises to reach the abutting position P1, the mechanism starts to rotate the feeding roller 15 again. Accordingly, even if the phenomenon of dragging the sheet S1 in the immediate preceding step drags the sheet S1 onto the separation pad 19, the sheet S1 can be fed in the state where the sheet S1 is in contact with two points, which are the abutting position P1 and the contact position P2. Accordingly, for instance, in the case of using the thin sheet having a low rigidity (low basic weight), occurrence of the buckling of the sheet due to the sheet dragging phenomenon can be suppressed. As a result, stable feeding can be performed while suppressing occurrence of sheet feeding failure. The highly reliable image forming apparatus can be provided.

The sheet-feeding portion 50A of the image forming apparatus 1A according to the second embodiment, for instance, can suppress occurrence of buckling of a thin sheet without complicated control but with the simple configuration, and can prevent occurrence of feeding failure. For instance, without addition of a mechanism for returning the dragged sheet S1, occurrence of buckling of the thin sheet can be alleviated, and occurrence of feeding failure can be suppressed. Accordingly, the sheet feeding apparatus that is compact and low cost and has high feeding stability can be provided.

The embodiments of the present invention have thus been described. However, the present invention is not limited to the aforementioned embodiments. The advantageous effects described in the embodiments of the present invention are a list of the most desirable effects caused by the present invention. The advantageous effects according to the present invention are not limited to the effects described in the embodiments of the present invention.

For instance, the second embodiment configures a play mechanism using the feeding shaft holder 31, the feeding roller holder 32 and the urging spring 33. However, the present invention is not limited thereto. For instance, the play mechanism may be realized by one of a clipped tooth where interchange is provided at a prescribed region and a cam.

For instance, this embodiment has described the detection unit using the flag 16 and the infrared light passage 17*a*. However, the present invention is not limited thereto. It is sufficient that the detection unit can detect the rotation of the feeding roller.

This embodiment has described the elevating unit using the cam and the cam follower. However, the present invention is not limited thereto. It is sufficient that the elevating unit can move up and down the sheet supporting portion 3.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-065999, filed Mar. 24, 2011, which is hereby incorporated by reference herein in its entirety.

What is claimed is:

1. A sheet feeding apparatus, comprising:

a sheet supporting portion that supports a sheet and is movable up or down;

a feeding roller that includes an arc-shaped friction portion to feed the sheet supported by the sheet supporting portion and a notch portion at which a part in a circumferential direction is cut out;

a rotation driving unit that rotationally drives the feeding roller;

a friction separation member that presses the sheet fed by the friction portion on a surface other than a surface at the friction portion, and separates a double-fed sheet; and an elevating unit that moves upward the sheet supporting portion; and a controlling device that controls the rotation driving unit and the elevating unit to position the sheet supporting portion below the feeding roller while the feeding roller is rotated, such that the sheet supporting on the sheet supporting portion is not in contact with the friction portion until the friction portion reaches the friction separation member and, when the friction portion reaches the friction separation member, to stop a rotation of the feeding roller and to move upward the sheet supporting portion to a push position at which the sheet supported on the sheet supporting portion is pressed against the friction portion, and when the sheet supporting portion is moved up to the push position, to start to rotate the feeding roller again to feed the sheet.

2. A sheet feeding apparatus according to claim 1, further comprising:

a detection unit that detects a rotational position of the feeding roller; and wherein when the detection unit detects that the friction portion reaches the friction separation member, the controlling device controls the rotation driving unit so as to stop the rotation of the feeding roller and causes the elevating unit to move upward the sheet supporting portion to the push position, and, when the sheet supporting portion reaches the push position, controls the rotation driving unit so as to rotate the feeding roller again.

3. A sheet feeding apparatus according to claim 1, further comprising:

a temporary stop mechanism that causes the rotation driving unit to drive the elevating unit, connects the rotation driving unit and the feeding roller to each other with intervention of a play mechanism, and, when the friction portion reaches the friction separation member, causes the play mechanism to temporarily stop the feeding roller, and, when the sheet supporting portion reaches the push position, rotates the feeding roller again.

4. A sheet feeding apparatus according to claim 3, wherein the temporary stop mechanism comprises: a feeding shaft that rotates in coordination with movement of the elevating unit by a rotation driving force from the rotation driving unit; a first rotary member fixed to the feeding shaft; a second rotary member that is connected to the feeding roller and rotatably supported by the feeding shaft;

and an urging spring that intervenes between the second rotary member and the first rotary member, and causes the second rotary member to operate in coordination with the first rotary member, the urging force being smaller than a frictional force caused between the friction portion and the friction separation member, and when the feeding shaft rotates and the friction portion reaches the friction separation member, the urging spring is compressed by a frictional force caused between the friction portion and the friction separation member to cancel interconnection between the first rotary member and the second rotary member and to stop the feeding roller, and, when the sheet supporting portion moves up to reach the push position and the urging spring is completely compressed, the second rotary member operates in coordination with rotation of the first rotary member to rotate the feeding roller again.

5. A sheet feeding apparatus according to claim 1, wherein the elevating unit comprises a cam follower connected to the sheet supporting portion; and a cam member on which a cam surface is formed that moves up and down the cam follower such that, after the friction portion of the feeding roller stops at the friction separation member, the sheet supporting portion can move to the push position.

6. An image forming apparatus, comprising:

a sheet supporting portion that supports a sheet and is provided so as to be movable up or down;

a feeding roller that includes an arc-shaped friction portion to feed the sheet supported by the sheet supporting portion and a notch portion at which a part in a circumferential direction is cut out;

a rotation driving unit that rotationally drives the feeding roller;

a friction separation member that presses the sheet fed by the friction portion on a surface other than a surface at the friction portion, and separates a double-fed sheet;

an elevating unit that moves upward the sheet supporting portion; and controlling device that controls the rotation driving unit and the elevating unit to position the sheet supporting portion below the feeding roller while the feeding roller is rotated, such that the sheet supporting on the sheet supporting portion is not in contact with the friction portion until the friction portion reaches the friction separation member, and, when the friction portion reaches the friction separation member, to stop a rotation of the feeding roller and to move upward the sheet supporting portion to a push position at which the sheet supported on the sheet supporting portion is pressed against the friction portion when the sheet supporting portion is moved upward to the push position, to start to rotate the feeding roller again to feed the sheet; and an image forming portion that forms an image on the sheet fed by the feeding roller.

7. An image forming apparatus according to claim 6, further comprising:

a detection unit that detects a rotational position of the feeding roller, wherein when the detection unit detects that the friction portion reaches the friction separation member, the controlling device controls the rotation driving unit so as to stop the rotation of the feeding roller and causes the elevating unit to move upward the sheet supporting portion to the push position, and, when the sheet supporting portion reaches the push position, controls the rotation driving unit so as to rotate the feeding roller again.

8. An image forming apparatus according to claim 6, further comprising:

a temporary stop mechanism that causes the rotation driving unit to drive the elevating unit, connects the rotation driving unit and the feeding roller to each other with intervention of a play mechanism, and, when the friction portion reaches the friction separation member, causes the play mechanism to temporarily stop the feeding roller, and, when the sheet supporting portion reaches the push position, rotates the feeding roller again.

9. An image forming apparatus according to claim 8, wherein the temporary stop mechanism comprises: a feeding shaft that rotates in coordination with movement of the elevating unit by a rotation driving force from the rotation driving unit; a first rotary member fixed to the feeding shaft; a second rotary member that is connected to the feeding roller and rotatably supported by the feeding shaft; and an urging spring that intervenes between the second rotary member and the first rotary member, and causes the second rotary member to operate in coordination with the first rotary member, the urging force being smaller than a frictional force caused between the friction portion and the friction separation member, and when the feeding shaft rotates and the friction portion reaches the friction separation member, the urging spring is compressed by a frictional force caused between the friction portion and the friction separation member to cancel interconnection between the first rotary member and the second rotary member and to stop the feeding roller, and, when the sheet supporting portion moves up to reach the push position and the urging spring is completely compressed, the second rotary member operates in coordination with the first rotary member to rotate the feeding roller again.

10. An image forming apparatus according to claim 6, wherein the elevating unit comprises a cam follower connected to the sheet supporting portion; and a cam member on which a cam surface is formed that moves up and down the cam follower such that, after the friction portion of the feeding roller stops at the friction separation member, the sheet supporting portion can move to the push position.

* * * * *